US011638856B1

(12) United States Patent
Peal et al.

(10) Patent No.: US 11,638,856 B1
(45) Date of Patent: May 2, 2023

(54) EXERCISE MACHINE RESISTANCE IDENTIFIER

(71) Applicant: Tonal Systems, Inc., San Francisco, CA (US)

(72) Inventors: Gabriel Peal, San Francisco, CA (US); Asim Kadav, Mountain View, CA (US)

(73) Assignee: Tonal Systems, Inc., San Francisco, CA (US)

( * ) Notice: Subject to any disclaimer, the term of this patent is extended or adjusted under 35 U.S.C. 154(b) by 0 days.

(21) Appl. No.: 17/825,957

(22) Filed: May 26, 2022

(51) Int. Cl.

| | |
|---|---|
| ***A63B 24/00*** | (2006.01) |
| ***A63B 71/06*** | (2006.01) |
| ***A63B 22/02*** | (2006.01) |
| ***A63B 22/00*** | (2006.01) |
| ***A63B 22/06*** | (2006.01) |

(52) U.S. Cl.
CPC ..... *A63B 24/0062* (2013.01); *A63B 22/0076* (2013.01); *A63B 22/02* (2013.01); *A63B 22/0605* (2013.01); *A63B 24/0087* (2013.01); *A63B 71/0619* (2013.01); *A63B 2071/0655* (2013.01); *A63B 2220/40* (2013.01); *A63B 2220/50* (2013.01); *A63B 2220/807* (2013.01); *A63B 2220/833* (2013.01); *A63B 2225/20* (2013.01)

(58) Field of Classification Search
CPC . A63B 22/0076; A63B 22/02; A63B 22/0605; A63B 24/0062; A63B 24/0087; A63B 71/0619; A63B 2071/0655; A63B 2220/40; A63B 2220/50; A63B 2220/807; A63B 2220/833; A63B 2225/20
See application file for complete search history.

(56) References Cited

U.S. PATENT DOCUMENTS

| | | | | |
|---|---|---|---|---|
| 9,643,071 | B2 | 5/2017 | Riley | |
| 10,065,076 | B2 | 9/2018 | Davis | |
| 10,458,838 | B2 * | 10/2019 | Lee | A63B 21/0728 |
| 10,589,163 | B2 | 3/2020 | Orady | |
| 10,878,952 | B1 * | 12/2020 | Patel | G06K 7/10297 |
| 2004/0063551 | A1 | 4/2004 | Lightbody | |
| 2005/0085348 | A1 | 4/2005 | Kiefer | |
| 2010/0160115 | A1 | 6/2010 | Morris | |
| 2010/0261579 | A1 | 10/2010 | Rice | |
| 2011/0294624 | A1 | 12/2011 | Burnfield | |
| 2016/0346617 | A1 * | 12/2016 | Srugo | A63B 21/0632 |
| 2018/0156657 | A1 * | 6/2018 | Lee | G01V 15/00 |
| 2019/0201730 | A1 | 7/2019 | Smith | |
| 2021/0308524 | A1 * | 10/2021 | Cernasov | A63B 21/0726 |
| 2022/0032115 | A1 | 2/2022 | Mallard | |
| 2022/0133198 | A1 * | 5/2022 | Popov | A61B 5/224 73/379.01 |

* cited by examiner

*Primary Examiner* — Joshua Lee
(74) *Attorney, Agent, or Firm* — Van Pelt, Yi & James LLP

(57) ABSTRACT

An exercise machine accessory is disclosed. In one embodiment, a resistance identifier is configured to identify resistance for an exercise machine associated with the exercise machine accessory, wherein the resistance identifier is coupled to the exercise machine. In one embodiment, a motion identifier is configured to identify exercise motion for a user of the exercise machine. In one embodiment, a communications module is configured to communicate with the user of the exercise machine, wherein the communications module is coupled to the resistance identifier and the motion identifier.

24 Claims, 9 Drawing Sheets

EXERCISE MACHINE RESISTANCE IDENTIFIER

BACKGROUND OF THE INVENTION

Personal strength training and/or aerobic exercise training using an exercise machine is convenient but usually done alone and/or at home, without the assistance of training staff. Such staff may provide feedback and accounting on training, such as: form feedback, guidance on tempo and cadence, repetition (rep) counting, strength evaluation, aerobic exercise evaluation, performance evaluation, and/or historical data/statistics. It would be an improvement to provide feedback and accounting for an exercise machine without the assistance of staff.

BRIEF DESCRIPTION OF THE DRAWINGS

Various embodiments of the invention are disclosed in the following detailed description and the accompanying drawings.

DETAILED DESCRIPTION

Figure 1:
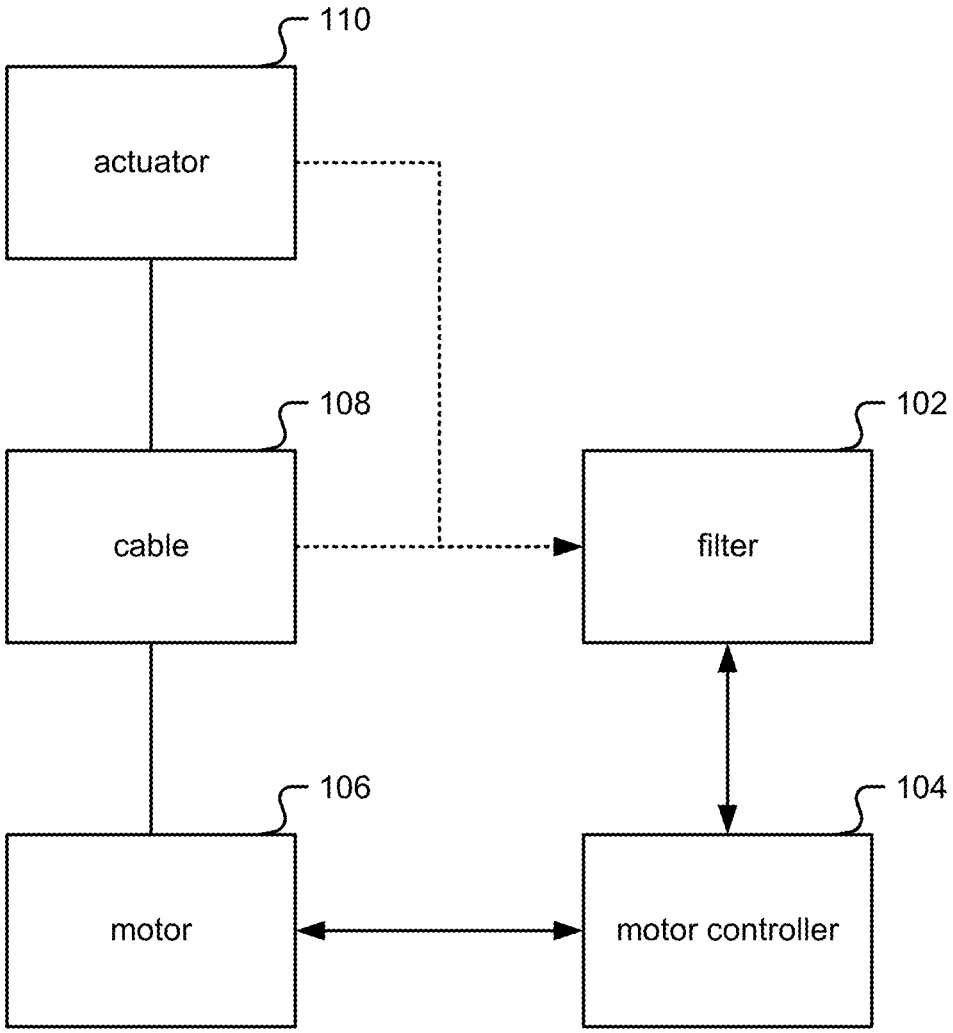
FIG. 1 is a block diagram illustrating an example of a smart exercise machine.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

An exercise machine resistance identifier is disclosed. As a user of an exercise machine may have access to one or more traditional exercise machines, an exercise machine resistance identifier may be part of an accessory, for example, an aftermarket accessory that allows a user to receive feedback and/or accounting on workouts when using the exercise machine. As referred to herein, 'resistance' is any force opposing motion and/or flow of a user, for example: a weight of a dumbbell; a weight of a barbell; a weight stack of a cable-based strength training machine; an incline of a treadmill; a belt speed of a treadmill; a damper of a rowing machine; a damper of a stationary bicycle machine; a damper of an elliptical training machine; and/or a damper of a stair climbing machine.

In one embodiment, the exercise machine accessory may make a traditional exercise machine 'smarter' by providing data to a processor through a computer communications module that may then use the data at least in part to provide feedback and/or to store for accounting. The communication module allows coupling to a computer, processor, computer network, or telecommunications network using an electrical and/or network connection. For example, through the communication module, a processor can receive information, for example, data objects or program instructions, from another network, or output information to another network in the course of performing method/process steps. Information, often represented as a sequence of instructions to be executed on a processor may be received from and outputted to another network. An interface module or similar device and appropriate hardware/firmware/software may be used to connect the accessory to an internal and/or external network and transfer data according to standard protocols. For example, various process embodiments disclosed herein may be performed across a network such as the Internet, intranet networks, or local area networks in conjunction with a remote processor that shares a portion of the processing. Throughout this specification, "network" refers to any interconnection between computer components including the Internet, Bluetooth, Bluetooth Low Energy (BLE), ZigBee, LoRaWAN, Z-Wave, SigFox, NB-IOT, LTE-M, WiFi, 3G, 4G, 4GLTE, 5G, GSM, Ethernet, intranet, local-area network ("LAN"), home-area network ("HAN"), serial connection, parallel connection, wide-area network ("WAN"), Fibre Channel, PCI/PCI-X, AGP, VLbus, PCI Express, Expresscard, Infiniband, ACCESS.bus, Wireless LAN, HomePNA, Optical Fibre, G.hn, infrared network, satellite network, microwave network, cellular network, virtual private network ("VPN"), Universal Serial Bus ("USB"), FireWire, Serial ATA, 1-Wire, UNI/O, or any form of connecting homogenous and/or heterogeneous systems and/or groups of systems together.

In one embodiment, the exercise machine accessory has a motion identifier to enhance feedback and/or accounting. Said motion identifier assesses a user's motion at least in part to determine at least a portion of a user's: strength, endurance, aerobic exercise, form, cadence, pace, reps, and/or tempo. That is, strength training exercises may be divided into sets. Each set includes one or more repetitions or 'reps.' A user typically performs one or more sets of a given exercise movement. With motion identified, the exercise machine accessory may enhance feedback to the user by way of coaching, collaborative encouragement such as a group workout over a network, competitive encouragement such as a group competition over a network, and/or storing motion for statistical/historical analysis.

In one embodiment, a motion identifier comprises at least one of the following: an inertial measurement unit (IMU); a gyroscope; an accelerometer; a camera; a computer vision system; a microphone; an audio analysis system; a heart rate monitor; a pulse oximetry (SpO2/SaO2) monitor; an oxygen consumption (VO2 max) monitor; an electrocardiography (ECG) monitor; a blood pressure monitor; a pulse monitor; a brainwave monitor; a photoplethysmogram (PPG) monitor; an electromyography (EMG) monitor; an electrooculography (EOG) monitor; an electroencephalography (EEG) monitor; and/or a biosignal monitor.

FIG. 1 is a block diagram illustrating an example of a smart exercise machine. This exercise machine includes the following:

a controller circuit (104), which may include a processor, inverter, pulse-width-modulator, and/or a Variable Frequency Drive (VFD);

a motor (106), for example, a three-phase brushless DC driven by the controller circuit;

a spool with a cable (108) wrapped around the spool and coupled to the spool. On the other end of the cable an actuator/handle (110) is coupled in order for a user to grip and pull on. The spool is coupled to the motor (106) either directly or via a shaft/belt/chain/gear mechanism. Throughout this specification, a spool may be also referred to as a "hub";

a filter (102), to digitally control the controller circuit (104) based on receiving information from the cable (108) and/or actuator (110);

optionally (not shown in FIG. 1) a gearbox between the motor and spool. Gearboxes multiply torque and/or friction, divide speed, and/or split power to multiple spools. Without changing the fundamentals of digital strength training, a number of combinations of motor and gearbox may be used to achieve the same end result. A cable-pulley system may be used in place of a gearbox, and/or a dual motor may be used in place of a gearbox;

one or more of the following sensors (not shown in FIG. 1): a position encoder; a sensor to measure position of the actuator (110). Examples of position encoders include a hall effect shaft encoder, grey-code encoder on the motor/spool/cable (108), an accelerometer in the actuator/handle (110), optical sensors, position measurement sensors/methods built directly into the motor (106), and/or optical encoders. In one embodiment, an optical encoder is used with an encoding pattern that uses phase to determine direction associated with the low resolution encoder. Other options that measure back-EMF (back electromagnetic force) from the motor (106) in order to calculate position also exist;

a motor power sensor; a sensor to measure voltage and/or current being consumed by the motor (106);

a user tension sensor; a torque/tension/strain sensor and/or gauge to measure how much tension/force is being applied to the actuator (110) by the user. In one embodiment, a tension sensor is built into the cable (108). Alternatively, a strain gauge is built into the motor mount holding the motor (106). As the user pulls on the actuator (110), this translates into strain on the motor mount which is measured using a strain gauge in a Wheatstone bridge configuration. In another embodiment, the cable (108) is guided through a pulley coupled to a load cell. In another embodiment, a belt coupling the motor (106) and cable spool or gearbox (108) is guided through a pulley coupled to a load cell. In another embodiment, the resistance generated by the motor (106) is characterized based on the voltage, current, or frequency input to the motor.

In one embodiment, a three-phase brushless DC motor (106) is used with the following:

a controller circuit (104) combined with filter (102) comprising:

a processor that runs software instructions;

three pulse width modulators (PWMs), each with two channels, modulated at 20 kHz;

six transistors in an H-Bridge configuration coupled to the three PWMs;

optionally, two or three ADCs (Analog to Digital Converters) monitoring current on the H-Bridge; and/or optionally, two or three ADCs monitoring back-EMF voltage;

the three-phase brushless DC motor (106), which may include a synchronous-type and/or asynchronous-type permanent magnet motor, such that:

the motor (106) may be in an "out-runner configuration" as described below;

the motor (106) may have a maximum torque output of at least 60 Nm and a maximum speed of at least 300 RPMs;

optionally, with an encoder or other method to measure motor position;

a cable (108) wrapped around the body of the motor (106) such that entire motor (106) rotates, so the body of the motor is being used as a cable spool in one case. Thus, the motor (106) is directly coupled to a cable (108) spool. In one embodiment, the motor (106) is coupled to a cable spool via a shaft, gearbox, belt, and/or chain, allowing the diameter of the motor (106) and the diameter of the spool to be independent, as well as introducing a stage to add a set-up or step-down ratio if desired. Alternatively, the motor (106) is coupled to two spools with an apparatus in between to split or share the power between those two spools. Such an apparatus could include a differential gearbox, or a pulley configuration; and/or an actuator (110) such as a handle, a bar, a strap, or other accessory connected directly, indirectly, or via a connector such as a carabiner to the cable (108).

In some embodiments, the controller circuit (102, 1004) is programmed to drive the motor in a direction such that it draws the cable (108) towards the motor (106). The user pulls on the actuator (110) coupled to cable (108) against the direction of pull of the motor (106).

One purpose of this setup is to provide an experience to a user similar to using a traditional cable-based strength training machine, where the cable is attached to a weight stack being acted on by gravity. Rather than the user resisting the pull of gravity, they are instead resisting the pull of the motor (106).

Note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

By contrast in a digital strength trainer, there is no actual weight stack. The notion of the weight stack is one modeled by the system. The physical embodiment is an actuator (110)

coupled to a cable (108) coupled to a motor (106). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $21\pi r$ for radius r. Likewise, torque of the motor (106) may be converted into linear force by multiplying it by radius r.

If the virtual/perceived "weight stack" is moving away from the ground, motor (106) rotates in one direction. If the "weight stack" is moving towards the ground, motor (106) rotates in the opposite direction. Note that the motor (106) is pulling towards the cable (108) onto the spool. If the cable (108) is unspooling, it is because a user has overpowered the motor (106). Thus, note a distinction between the direction the motor (106) is pulling, and the direction the motor (106) is actually turning.

If the controller circuit (102, 1004) is set to drive the motor (106) with, for example, a constant torque in the direction that spools the cable, corresponding to the same direction as a weight stack being pulled towards the ground, then this translates to a specific force/tension on the cable (108) and actuator (110). Calling this force "Target Tension," this force may be calculated as a function of torque multiplied by the radius of the spool that the cable (108) is wrapped around, accounting for any additional stages such as gear boxes or belts that may affect the relationship between cable tension and torque. If a user pulls on the actuator (110) with more force than the Target Tension, then that user overcomes the motor (106) and the cable (108) unspools moving towards that user, being the virtual equivalent of the weight stack rising. However, if that user applies less tension than the Target Tension, then the motor (106) overcomes the user and the cable (108) spools onto and moves towards the motor (106), being the virtual equivalent of the weight stack returning.

BLDC Motor. While many motors exist that run in thousands of revolutions per second, an application such as fitness equipment designed for strength training has different requirements and is by comparison a low speed, high torque type application suitable for a BLDC motor.

In one embodiment, a requirement of such a motor (106) is that a cable (108) wrapped around a spool of a given diameter, directly coupled to a motor (106), behaves like a 200 lbs weight stack, with the user pulling the cable at a maximum linear speed of 62 inches per second. A number of motor parameters may be calculated based on the diameter of the spool.

| User Requirements | |
|---|---|
| Target Weight | 200 lbs |
| Target Speed | 62 inches/sec = 1.5748 meters/sec |

Thus, a motor with 67.79 Nm of force and a top speed of 395 RPM, coupled to a spool with a 3 inch diameter meets these requirements. 395 RPM is slower than most motors available, and 68 Nm is more torque than most motors on the market as well.

Hub motors are three-phase permanent magnet BLDC direct drive motors in an "out-runner" configuration: throughout this specification out-runner means that the permanent magnets are placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motors also tend to be "pancake style." As described herein, pancake motors are higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor is a motor that has a diameter higher than twice its depth. As described herein, a pancake motor is between 15 and 60 centimeters in diameter, for example, 22 centimeters in diameter, with a depth between 6 and 15 centimeters, for example, a depth of 6.7 centimeters.

Motors may also be "direct drive," meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternately, a 2:1 gear ratio may be used to accomplish the same thing. Likewise, the diameter of the spool may be adjusted to accomplish the same.

Alternately, a motor with 100× the speed and 100th the torque may also be used with a 100:1 gearbox. As such a gearbox also multiplies the friction and/or motor inertia by 100×, torque control schemes become challenging to design for fitness equipment/strength training applications. Friction may then dominate what a user experiences. In other applications friction may be present, but is low enough that it is compensated for, but when it becomes dominant, it is difficult to control for. For these reasons, direct control of motor speed and/or motor position as with BLDC motors is more appropriate for fitness equipment/strength training systems.

| Requirements by Spool Size | | | | | | |
|---|---|---|---|---|---|---|
| Diameter (inches) | 3 | 5 | 6 | 7 | 8 | 9 |
| RPM | 394.7159 | 236.82954 | 197.35795 | 169.1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

Figure 2:
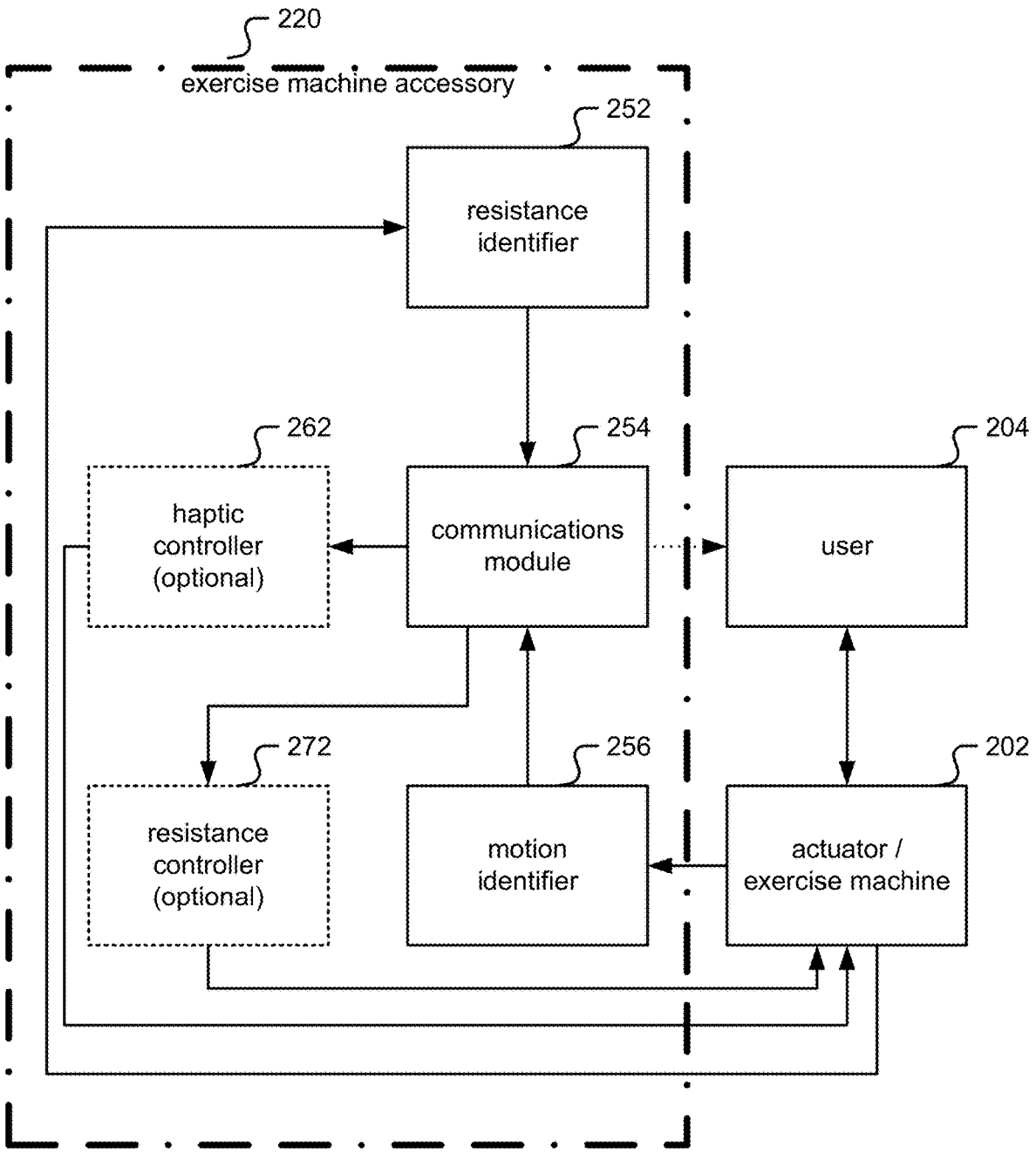
FIG. 2 is a block diagram illustrating an embodiment of an exercise machine accessory.

FIG. 2 is a block diagram illustrating an embodiment of an exercise machine accessory. An exercise machine including an actuator (202) such as a grip/handle may not be a 'smart' exercise machine as shown in FIG. 1, but may still be improved to give a similar set of feedback and/or accounting that the smart exercise machine provides for a user (204).

Exercise machine accessory (220) comprises:

a resistance identifier (252). As described above, the resistance identifier (252) may identify, enumerate, calculate, analyze, and/or determine the resistance that user (204) is exerting against exercise machine (202). The resistance identifier (252) may then transmit this data to the communications module (254);

communications module (254). As described above, the communications module (254) may communicate data from the various coupled elements of the exercise machine accessory (220) to a processor and/or the user (204). In one embodiment, the communications module (254) is coupled directly with a processor and the communications happen along traces within an integrated circuit and/or a circuit board. In one embodiment, the communications module (254) is coupled to an app on a mobile device such as a phone or tablet;

motion identifier (256). As described above, the motion identifier (256) may identify, enumerate, calculate, analyze, and/or determine the motion that user (204) is experiencing during exercise. The motion identifier (256) may then transmit this data to the communications module (254);

optionally a haptic controller (262). A haptic controller (262) may receive data from the communications module (254) and may transmit haptic feedback to the user (204) during exercise. For example, a user (204) may use a barbell (202) as an exercise machine and if the bar is beginning to tilt, the accessory may detect the tilt as a dangerous condition for the user (204) and transmit a haptic buzz to a user's haptic equipped gloves to alert the user (204) to the danger; and optionally a resistance controller (272). A resistance controller (272) may receive data from the communications module (254) and may further control resistance for the user (204) on an exercise machine equipped with resistance adjustment. For example, a user (204) may use a stationary bicycle (202) as an exercise machine with a screw-type belt tensioner against a wheel, and an aftermarket motorized resistance adjustment may be added to the screw-type tensioner as part of the exercise machine accessory. The accessory may then simulate a 'hills' workout by monitoring the user's progress through a course and using the resistance controller (272) to control the motorized resistance adjustment to increase resistance on the uphill portion of the hills and decrease resistance on the downhill portion of the hills on the exercise machine (202).

Converting an exercise machine that is not a 'smart exercise machine' to be more smart with a resistance identifier and/or motion identifier provides improvement in at least one of the following aspects:

providing form feedback on a user's exercise motion to help improve a user's safety/efficiency during exercise. For example, the system of FIG. 2 may guide a user who is not performing a bicep curl properly and over extending their elbow;

assisting in 'rep counting' to help accounting of the number of reps a user has attempted and/or completed. Alternately for aerobic exercise the system of FIG. 2 may help accounting of a user's aerobic achievement attempted and/or completed, for example, how many kilometers the user has bicycled;

coaching in 'tempo guidance' to help improve a user's safety/efficiency during exercise for cadence/tempo of one or more movements. For example, the system of FIG. 2 may help coach time spent on the eccentric phase, midpoint, concentric phase, and starting point; and/or rest time in between reps.

recording and/or accounting for historical data/statistics for a current workout. For example, the system of FIG. 2 may help compare a left arm dumbbell and a right arm dumbbell, for example, the distance from center and/or the twist in motion between left and right. For example, the system of FIG. 2 may help compare a current workout to a past workout of the same type, and help coach by encouraging a user when underperforming historically and/or cheering a user when performing better than historically.

Figure 3A:
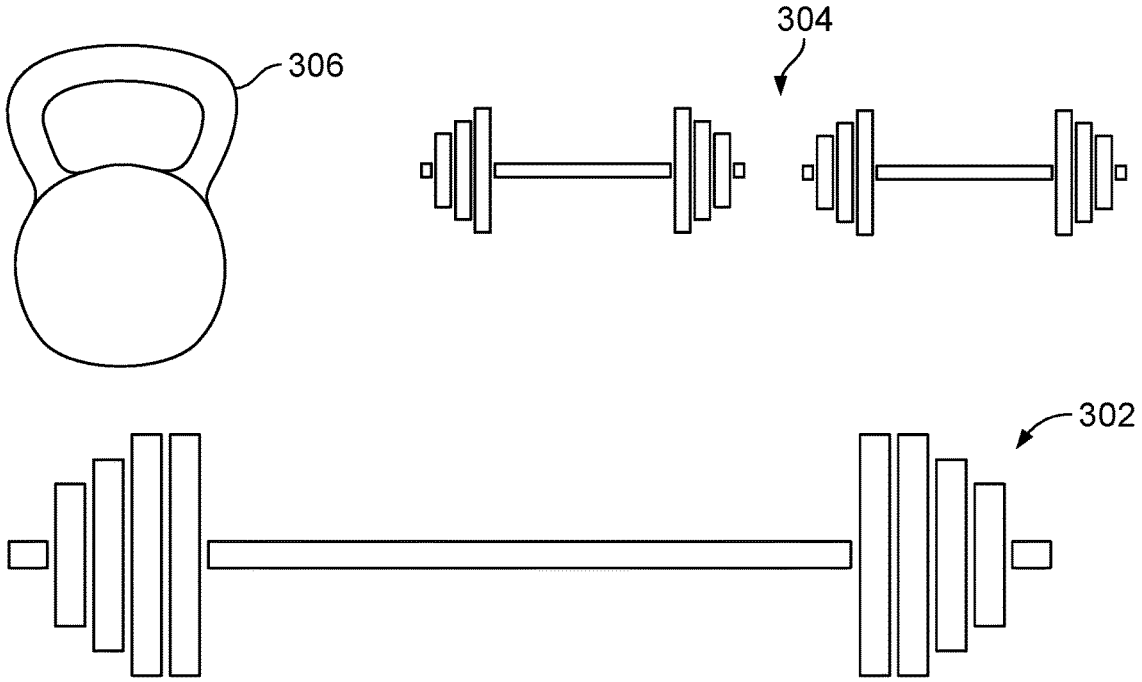
FIGS. 3A, 3B, and 3C are illustrations of an exercise machine accessory for free-weights.
Figure 3B:
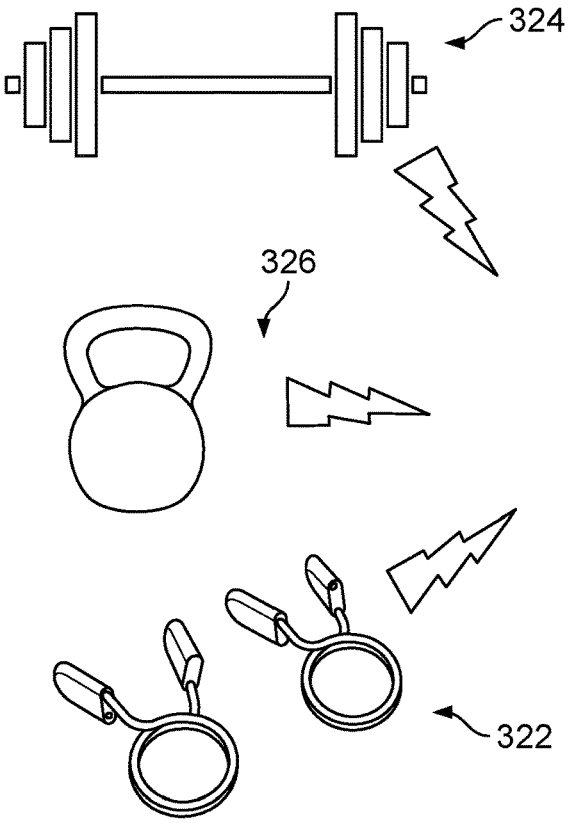
Figure 3C:
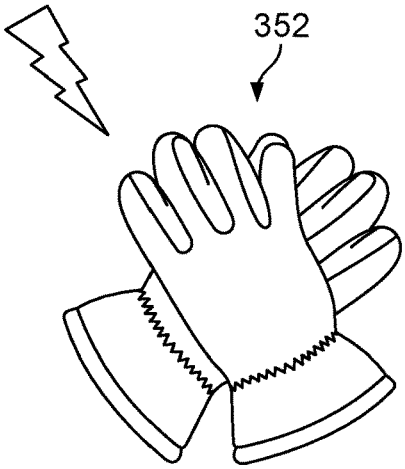

Making Strength Training Machines 'Smart.' FIGS. 3A, 3B, and 3C are illustrations of an exercise machine accessory for free-weights. In one embodiment, the accessory of FIGS. 3A, 3B, and 3C is a more specific accessory of the type shown in FIG. 2.

As shown in FIG. 3A, the exercise machine accessory may attach to barbells (302), dumbbells, (304), and/or other free-weights, for example, kettle bells (306). As shown in FIG. 3B, the resistance identifier (252) of FIG. 2 for such free-weights may be a barbell clasp and/or clip (322), a marker for a barbell/dumbbell (324), and/or a set of free-weights (326).

In one embodiment, the clip (322) is assigned and/or measures the weight associated with the free-weight (302)/(304)/(306) as a resistance identifier (252). For example, a user may use a set of clips, one for each free-weight in their set, such as a 10 lb clip for their 10 lb free-weight, 25 lb clip for their 25 lb free-weight, and so on.

In one embodiment, instead of a clip, any device between the user and the exercise actuator such as (not shown) a set of cylindrical pads wrapped around the user grip area and/or a set of user gloves (e.g., sheathed gloves) may be used for a resistance identifier (252). As a user exercises with any free-weight in their set, the weight lifted may be computed based at least in part on compression of the pads and/or gloves and the known gravitational force, for example, through the use of a load cell/force transducer in the pads and/or gloves, since the user exerts force against the free-weight by way of the pads and/or gloves. Similarly, a motion identifier (256) may be used inside the pads and/or gloves.

In one embodiment, the clip (322) includes a motion identifier (256) based at least in part on an IMU, gyroscope, accelerometer, and/or global positioning sensor, for example, one based on satellites such as GPS, GLONASS, Galileo, BeiDou, IRNSS, and/or QZSS satellites. Another relevant example sensor technology is Bluetooth Low Energy (BLE), which may use Angle of Arrival (AoA) and Angle of Departure (AoD) to determine a position of an object in 3D space, and also to perform the indoor positioning and reckoning discussed later in the paragraph. This type of motion identifier may be replicated to other variations. The motion identifier (256) tracks motion so that a processor coupled with a clip communications module (254) may analyze the physical work accomplished by a user with the free-weight, and/or analyze a user's form in exercising with the free-weight. For an indoor exercise experience and/or when external/satellite position is unavailable, a dead reckoning system may be used based at least in part on previously determined position and/or velocity vectors.

In one embodiment, a resistance identifier (252) is a clip (322) with a system to allow a user to select the current weight of the barbell (302) or other associated free-weight (304)/(306), for example, using user tapping, buttons, voice recognition, and/or a touch screen. For example, the user may select "100 lb" when putting on barbell plates summing 80 lb for a 20 lb bar. This configurable clip is then registered to the weight until its removal.

In one embodiment, a marker for a free-weight (324) is assigned and/or measures the weight associated with the free-weight (302)/(304)/(306) as a resistance identifier (252). For example, a user may use a set of RFID/NFC attachments/adhesives that identifies their 10 lb barbell plate/dumbbell/kettle bell with a 10 lb marker, 25 lb free-weight with a 25 lb marker, and so on. Alternately a colored and/or retroreflective marker is used in conjunction with an optical tracking system in an external device such as a mobile device to identify the resistance. As NFC may not permeate an iron barbell plate, the NFC attachment may be a plastic or otherwise permeable collar at the center of the plate, such that the clip (322) for the bar may then read the NFC plates in series. Low power broadcasting protocols such as RFID may be used to sum plates as well.

In one embodiment, a drift correction system for correcting IMU drift is used in the motion identifier (256). The drift correction system may use any traditional system used, for example, in the virtual reality (VR)/augmented reality (AR)/motion capture (MoCap) field. The drift correction system may further leverage that free-weights eventually are returned to the ground at the end of a movement, a rep, and/or a set, which provides a known elevation basis/level, i.e., a known z-axis. The drift correction system may further be improved by providing a 'home base' for the free-weights to sit in at the end of a movement/rep/set, and provide a known plan position, i.e., a known x-axis and/or y-axis.

In one embodiment, powering the resistance identifier (252) and/or motion identifier (256) is a battery system, a solar photovoltaic system, and/or a kinetic movement system, for example, one that charges a battery and/or flywheel using motion from the exercise movement itself.

As shown in FIG. 3B, there is a communications output for clasp (322)/marker (324)/dedicated weight (326), herein denoted by a cartoon lightning bolt to the right of the device. This communications output uses communications module (254) and a network protocol, typically a wireless communications protocol such as BLE (Bluetooth Low Energy), Thread, 6LoWPAN, Bluetooth Mesh, Zigbee, Z-Wave, Wi-Fi HaLow, Bluetooth 5, Wirepas, NFC, RFID, Li-Fi, MiraOS, VEmesh, Wi-Fi, Wi-Fi Direct, Wi-Fi EasyMesh, DASH7, KNX, LonWorks, BACnet, NB-IOT, LTE-Advanced, LTE-M, 5G, LPWAN, LoRaWAN, Sigfox, Weightless, RPMA, and/or VSAT. The communications module (254) communicates with a processor, such as a processor in a mobile device like a phone or tablet, to provide the 'smart exercise machine' features such as virtual coaching, human personal training via a videoconference, team collaboration, performance feedback, competitive leaderboard, congratulatory shout out, live class experience, suggested weight, peer performance/experience, peer feedback, form feedback, range of motion calculation, form graphical feedback, rep counting, tempo guidance, and/or historical data/statistics.

As shown in FIG. 3C, a haptic controller (262) as shown in FIG. 2 may be associated with any device touching the user like gloves (352), for example, sheathed gloves. The haptic controller/gloves provide a channel of feedback to a user performing the exercise, for example, to warn of safety hazards, coach performance, and/or permit gaming and entertainment. As shown in FIG. 3C, there is a communications input for haptic gloves (352), herein denoted by a cartoon lightning bolt to the left of the device. This communications input uses communications module (254) and a network protocol.

Computer Vision. In one embodiment, the exercise machine accessory (220) in FIG. 2 including resistance identifier (252) and/or motion identifier (256) is computer vision-based, not requiring any additional hardware beyond a mobile device. In one embodiment, a mobile device and exercise machine accessory may share the processing of user motion data. The computer vision system may perform resistance identification (252) using computer vision to determine resistance, for example, by observing and OCRing (optically character recognize) the weights printed on a barbell/dumbbell/kettle bell and/or observing the physical size of a barbell plate and analyzing the weight. In one embodiment, distinct colors are used for each of the plates and calculating the weights. In one embodiment, distinct textures are used for each of the plates and calculating the weights. This system may be enhanced with a user setup, for example, with a set of bar/QR code/color coded/retroreflective stickers that may be attached to each plate and/or free-weight.

In one embodiment, sensor fusion is used to integrate computer vision and IMU data. The sensor fusion comprises synchronization of a plurality of asynchronous data sources such as computer vision and IMU. In one embodiment, the different output variables from computer vision and IMUs are algebraically combined. Sensor fusion may, for example, be obtained by combining the sources of information using an expression evaluator. This may include establishing a shared time framework, for example, NTP (Network Time Protocol) and/or a derivative of NTP. A direct socket connection and/or WebRTC may be used to communicate between the data sources. This sensor fusion may be integrated with other data sources such as a trainer video on the mobile device. Latency from processor computation, network conditions, and server conditions may be controlled using a control loop.

Figure 4A:
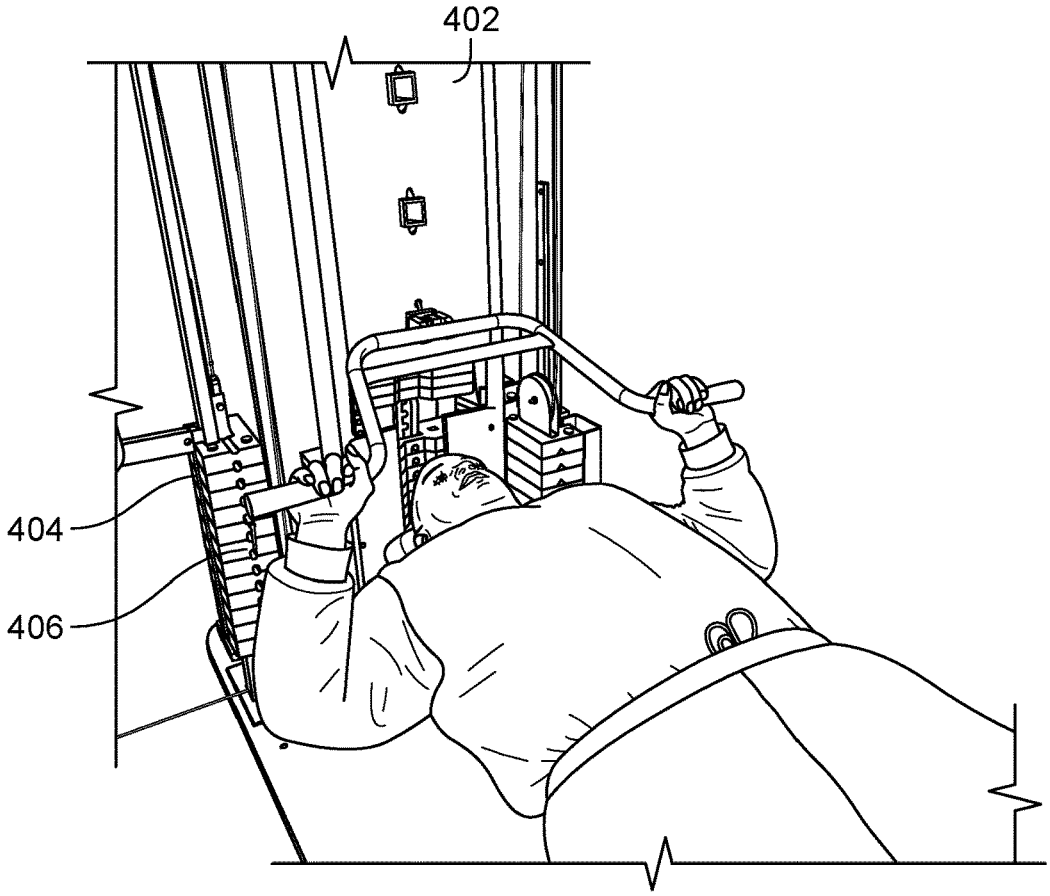
FIGS. 4A, 4B, and 4C are illustrations of an exercise machine accessory for cable-based exercise machines.
Figure 4B:
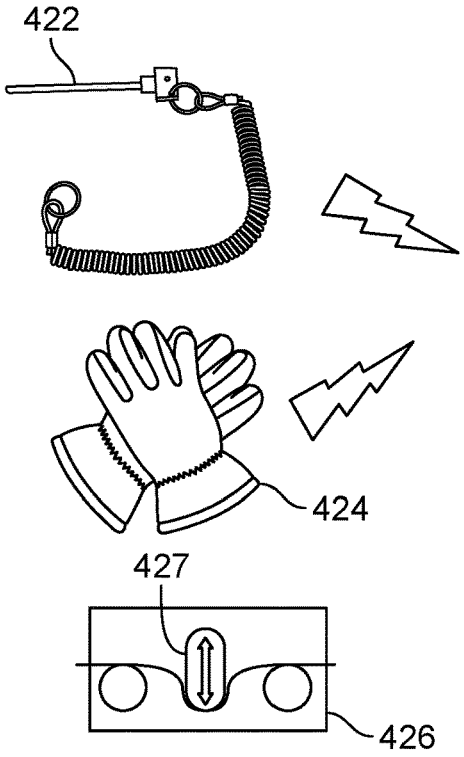
Figure 4C:
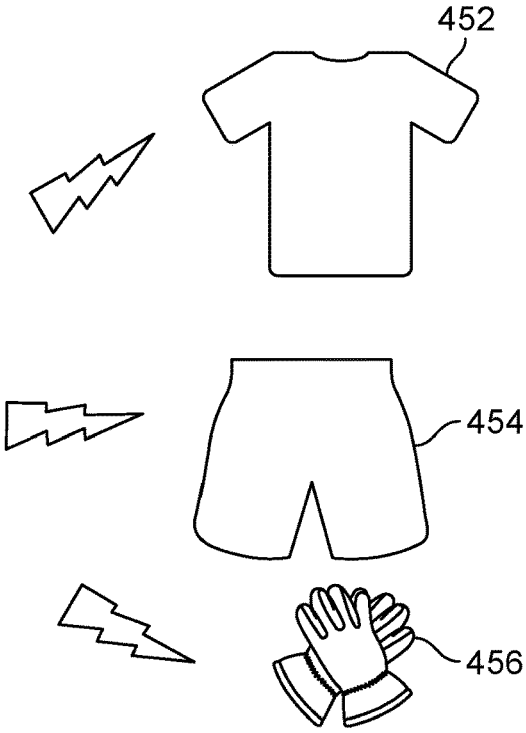

FIGS. 4A, 4B, and 4C are illustrations of an exercise machine accessory for cable-based exercise machines. In one embodiment, the accessory of FIGS. 4A, 4B, and 4C is a more specific accessory of the type shown in FIG. 2.

As shown in FIG. 4A, the exercise machine accessory may attach to a cable-based exercise machine (402), which typically includes a stack of weight plates (404) and a pin (406) to select one or more weight plates as resistance for the user. As shown in FIG. 4B, the resistance identifier (252) of FIG. 2 for such cable-based machines may be associated with the weight stack (404) such as a 'smart' pin (422), a device on the top of the weight stack (not shown), and/or a device between one or more weight plates of the weight stack (not shown) that make a 'smart' weight stack. An alternate resistance identifier is a cable tension meter (426), for example, a non-intrusive design that allows measuring tension without cutting or altering the cable that positions the cable using pulleys against a perpendicular load cell (427). In one embodiment, this design is used with a clamshell case that allows a user to set up the cable against the pulleys and load cell (427) and then close the case to maintain its position without slippage. As shown in FIG. 4B, the resistance identifier (252) may also include any device between the user and the exercise actuator such as gloves (424).

In one embodiment, the 'smart' weight stack device (422) is assigned and/or measures the weight/resistance that the user is exerting against weight (404) as a resistance identifier (252). For example, a user may push a 'smart' pin (422) at 100 lb to set up a 100 lb bench press on the cable machine (402), which the system of FIG. 2 may then identify 100 lb as the identified resistance.

In one embodiment, instead of a clip, any device between the user and the exercise actuator/handles such as (not shown) a set of cylindrical pads wrapped around the user grip area and/or a set of user gloves (424) may be used for a resistance identifier (252). As a user exercises with any weight on the cable-based machine (402), the weight lifted may be computed based at least in part on compression of the pads and/or gloves and the known gravitational force, for example, through the use of a load cell/force transducer in the pads and/or gloves, since the user exerts force against the resistance by way of the pads and/or gloves. Similarly, a motion identifier (256) may be used inside the pads and/or gloves.

In one embodiment, the resistance identifier device (422), (424) includes a motion identifier (256) based at least in part on an MU, gyroscope, accelerometer, and/or global positioning sensor, for example, one based on satellites such as GPS, GLONASS, Galileo, BeiDou, IRNSS, and/or QZSS satellites. The motion identifier (256) tracks motion so that a processor coupled with a communications module (254) may analyze the physical work accomplished by a user with the cable-based machine, and/or analyze a user's form in exercising with the cable-based machine. For an indoor exercise experience and/or when external/satellite position is unavailable, a dead reckoning system may be used based at least in part on previously determined position and/or velocity vectors.

In one embodiment, a resistance identifier (252) is a device (not shown) with a system to allow a user to select the current weight of the weight stack (404), for example, using user tapping, buttons, voice recognition, and/or a touch screen. For example, the user may select "100 lb" when putting pin (406) in the weight stack (404). This configurable device is then registered to the weight until its removal.

In one embodiment, a marker for a weight stack (404) is assigned and/or measures the weight associated with the weight stack as a resistance identifier (252). For example, a user may use a set of RFID/NFC attachments/adhesives that identifies each weight stack plate with a marker, for example, if the system detects that 5 weight stack plates are moving then it may infer that the resistance is 50 lb if each weight stack plate is configured to be 10 lb. In one embodiment, plates are of different weight and may be differentiated between, for example the system may detect 25 lb if it detects two 10 lb weight stack plates and a 5 lb weight stack plate are moving. For example, a user may use a set of RFID/NFC attachments/adhesives that identifies the cumulative weight being pinned in a weight stack, for example, if the system detects that the index of the largest indexed weight stack plate moving is 50 lb, it may infer that the resistance is 50 lb.

Alternately a colored and/or retroreflective marker is used in conjunction with an optical tracking system in an external device such as a mobile device to identify the resistance. As NFC may not permeate a weight stack plate, the NFC attachment may be a plastic or otherwise permeable collar at a position on the plate, such that the device (424) may then read the NFC plates in series through the plastic. Low power broadcasting protocols such as RFID may be used to sum weight stack plates as well.

In one embodiment, a drift correction system for correcting IMU drift is used in the motion identifier (256). The drift correction system may use any traditional system used, for example, in the virtual reality (VR)/augmented reality (AR)/motion capture (MoCap) field. The drift correction system may further leverage that a weight stack is eventually returned to resting at the end of a movement, a rep, and/or a set, which provides a known elevation basis/level, i.e., a known x-axis, y-axis, and/or z-axis.

In one embodiment, powering the resistance identifier (252) and/or motion identifier (256) is a battery system, a solar photovoltaic system, and/or a kinetic movement system, for example, one that charges a battery and/or flywheel using motion from the exercise movement itself.

As shown in FIG. 4B, there is a communications output for device (422)/(424), herein denoted by a cartoon lightning bolt to the right of the device. This communications output uses communications module (254) and a network protocol, typically a wireless communications protocol such as BLE (Bluetooth Low Energy), Thread, 6LoWPAN, Bluetooth Mesh, Zigbee, Z-Wave, Wi-Fi HaLow, Bluetooth 5, Wirepas, NFC, RFID, Li-Fi, MiraOS, VEmesh, Wi-Fi, Wi-Fi Direct, Wi-Fi EasyMesh, DASH7, KNX, LonWorks, BACnet, NB-IOT, LTE-Advanced, LTE-M, 5G, LPWAN, LoRaWAN, Sigfox, Weightless, RPMA, and/or VSAT. The communications module (254) communicates with a processor, such as a processor in a mobile device like a phone or tablet, to provide the 'smart exercise machine' features such as virtual coaching, human personal training via a videoconference, team collaboration, performance feedback, competitive leaderboard, congratulatory shout out, live class experience, suggested weight, peer performance/experience, peer feedback, form feedback, form graphical feedback, rep counting, tempo guidance, and/or historical data/statistics.

As shown in FIG. 4C, a haptic controller (262) as shown in FIG. 2 may be associated with any device touching the user within a clothing top (452), and/or a clothing bottom (454), and/or gloves (456) (e.g., sheathed gloves). The haptic controller/gloves provide a channel of feedback to a user performing the exercise, for example, to warn of safety hazards, coach performance, and/or permit gaming and entertainment. As shown in FIG. 4C, there is a communications input for haptic devices (452)/(454)/(456), herein denoted by a cartoon lightning bolt to the left of the device. This communications input uses communications module (254) and a network protocol.

Computer Vision. In one embodiment, the exercise machine accessory (220) in FIG. 2 including resistance identifier (252) and/or motion identifier (256) is computer vision-based, not requiring any additional hardware beyond a mobile device. In one embodiment, a mobile device and exercise machine accessory may share the processing of user motion data. The computer vision system may perform resistance identification (252) using computer vision to determine resistance, for example, by observing and OCRing (optically character recognize) the weight stack index printed on a plate of a weight stack and/or observing the physical size of a moving weight stack and analyzing the weight. This system may be enhanced with a user setup, for example, with a set of bar/QR code/color coded/retroreflective stickers that may be attached to each weight stack plate.

In one embodiment, sensor fusion is used to integrate computer vision and IMU data. The sensor fusion comprises synchronization of a plurality of asynchronous data sources such as computer vision and IMU. In one embodiment, the different output variables from computer vision and IMUs are algebraically combined. This may include establishing a shared time framework, for example, NTP and/or a derivative of NTP. A direct socket connection and/or WebRTC may be used to communicate between the data sources. This sensor fusion may be integrated with other data sources such as a trainer video on the mobile device. Latency from processor computation, network conditions, and server conditions may be controlled using a control loop.

The example given in FIGS. 4A, 4B, and 4C are without limitation shown to be for cable-based machines, but any person having ordinary skill in the art recognizes that the same principles disclosed may be used with other gravity-based resistance machines such as fixed-track machines and/or body weight machines, and alternate resistance machines such as ones based on springs, flexing rods, flexing nylon rods, elastics, rubber bands, pneumatics, and hydraulics.

Figure 5A:
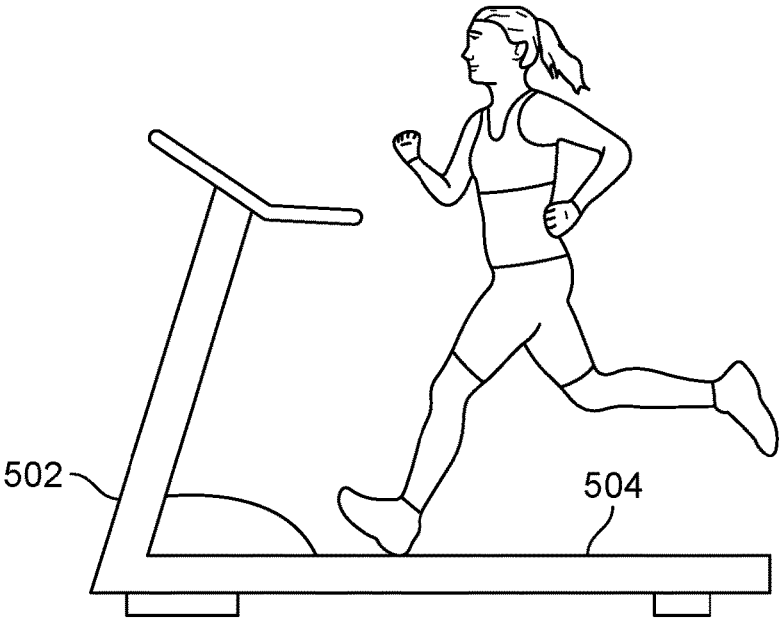
FIGS. 5A, 5B, and 5C are illustrations of an exercise machine accessory for treadmill type exercise machines.
Figure 5B:
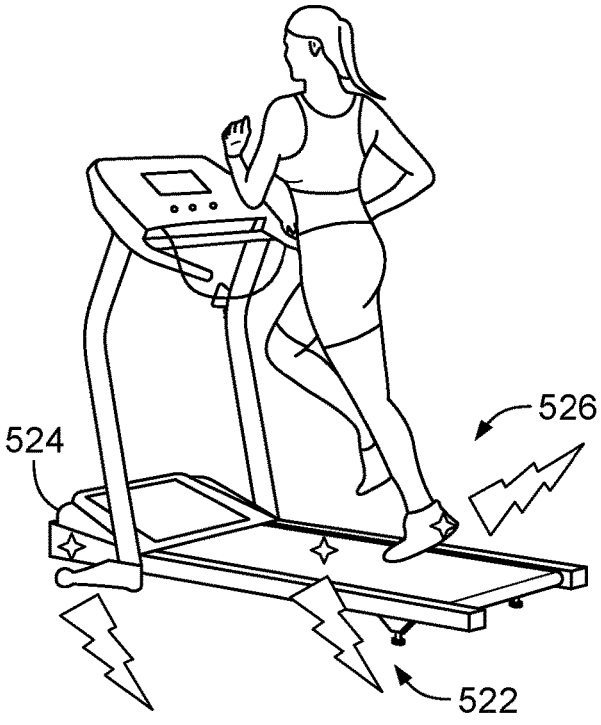
Figure 5C:
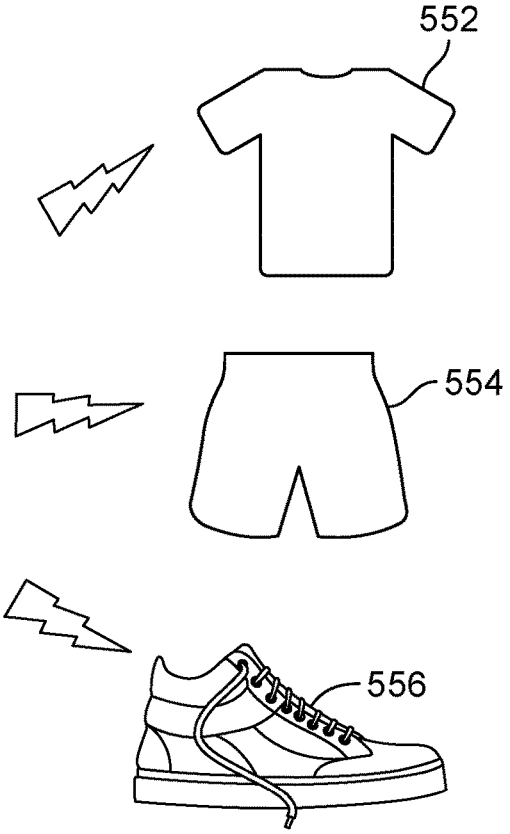

Making Aerobic Exercise Machines 'Smart.' The exercise machine accessory (220) of FIG. 2 may be used for nearly any exercise machine, including strength training machines as shown in FIGS. 3A, 3B, 3C, 4A, 4B, and 4C, and aerobic exercise machines. FIGS. 5A, 5B, and 5C are illustrations of an exercise machine accessory for treadmill type exercise machines. In one embodiment, the accessory of FIGS. 5A, 5B, and 5C is a more specific accessory of the type shown in FIG. 2.

As shown in FIG. 5A, the exercise machine accessory may attach to a treadmill type exercise machine (502), which typically includes a tread belt (504) for the user to walk and/or run on. As shown in FIG. 5B, the resistance identifier (252) of FIG. 2 for such treadmill type exercise machines may be associated with the tread belt (522) such as an optical encoder for belt position sensing and/or an incline sensor (524) to show how fast a user has gone, how far a user has gone, and at what incline a user is treading. As shown in FIG. 5B, the resistance identifier (252) may also include any device between the user and the exercise actuator such as shoes or devices under shoes (526).

In one embodiment, the 'smart' resistance identifier device (522) is assigned and/or measures the resistance that the user is exerting against the treadmill type exercise machine (502) as a resistance identifier (252). For example, a user may use a mobile device camera in conjunction with an optically encoded belt using visible stickers to determine the speed/distance a user is running. Similarly, RFID/NFC markers may be used with wireless receivers to determine the speed/distance a user is running.

As a user exercises with the treadmill machine (502), the force exerted may be computed based at least in part on compression on the feet (526) and the known gravitational force, for example, through the use of a load cell/force transducer under the feet, since the user exerts force against the resistance by way of the feet. Similarly, a motion identifier (256) may be used with the shoes (526).

In one embodiment, the resistance identifier device (522)/(524)/(526) includes a motion identifier (256) based at least in part on an MU, gyroscope, accelerometer, and/or global positioning sensor, for example, one based on satellites such as GPS, GLONASS, Galileo, BeiDou, IRNSS, and/or QZSS satellites. The motion identifier (256) tracks motion so that a processor coupled with a communications module (254) may analyze the physical work accomplished by a user with the treadmill type exercise machine and/or analyze a user's form in exercising with the treadmill type exercise machine. For an indoor exercise experience and/or when external/satellite position is unavailable, a dead reckoning system may be used based at least in part on previously determined position and/or velocity vectors.

In one embodiment, a resistance identifier (252) is a device (not shown) with a system to allow a user to select the current treadmill speed, incline, and/or difficulty of the treadmill (502), for example, using user tapping, buttons, voice recognition, and/or a touch screen. For example, the user may select "5 mph, 10 degree incline," and this is then registered to the user. In one embodiment, computer vision and/or an accelerometer attached to the base is used to detect incline. In one embodiment, audible frequency is used to detect speed to exploit the relationship that frequency increases as the belt goes faster. For example, a frictional emitter may be used along the belt to assist enhancing the audible signal. In one embodiment, track gait and/or stride length may be assessed against pitch to determine treadmill speed. In one embodiment, gait and/or tempo are used as a basis for form feedback.

Similar question for other variations, such as control of stair climber

In one embodiment, a drift correction system for correcting IMU drift is used in the motion identifier (256). The drift correction system may use any traditional system used, for example, in the virtual reality (VR)/augmented reality (AR)/motion capture (MoCap) field.

In one embodiment, powering the resistance identifier (252) and/or motion identifier (256) is a battery system, a solar photovoltaic system, and/or a kinetic movement system, for example, one that charges a battery and/or flywheel using motion from the exercise movement itself.

As shown in FIG. 5B, there is a communications output for device (522)/(524)/(526), herein denoted by a cartoon lightning bolt out of the device. This communications output uses communications module (254) and a network protocol, typically a wireless communications protocol such as BLE (Bluetooth Low Energy), Thread, 6LoWPAN, Bluetooth Mesh, Zigbee, Z-Wave, Wi-Fi HaLow, Bluetooth 5, Wirepas, NFC, RFID, Li-Fi, MiraOS, VEmesh, Wi-Fi, Wi-Fi Direct, Wi-Fi EasyMesh, DASH7, KNX, LonWorks, BACnet, NB-IOT, LTE-Advanced, LTE-M, 5G, LPWAN, LoRaWAN, Sigfox, Weightless, RPMA, and/or VSAT. The communications module (254) communicates with a processor, such as a processor in a mobile device like a phone or tablet, to provide the 'smart exercise machine' features such as virtual coaching, human personal training via a videoconference, team collaboration, performance feedback, competitive leaderboard, congratulatory shout out, live class experience, suggested weight, peer performance/experience, peer feedback, form feedback, form graphical feedback, rep counting, tempo guidance, and/or historical data/statistics.

As shown in FIG. 5C, a haptic controller (262) as shown in FIG. 2 may be associated with any device touching the user within a clothing top (552), and/or a clothing bottom (554), and/or shoes (556) (e.g., an insole). The haptic controller/gloves provide a channel of feedback to a user performing the exercise, for example, to give a tread cadence by buzzing a foot when a foot fall is scheduled to happen, warn of safety hazards, coach performance, and/or permit gaming and entertainment. As shown in FIG. 5C, there is a communications input for haptic devices (552)/(554)/(556), herein denoted by a cartoon lightning bolt into the device. This communications input uses communications module (254) and a network protocol.

Computer Vision/MoCap. In one embodiment, the exercise machine accessory (220) in FIG. 2 including resistance identifier (252) and/or motion identifier (256) is computer vision-based, not requiring any additional hardware beyond a mobile device. In one embodiment, a mobile device and exercise machine accessory may share the processing of user motion data. The computer vision system may perform resistance identification (252) using computer vision to determine resistance, for example, by observing user motion. This system may be enhanced with a user setup, for example, with a set of bar/QR code/color coded/retroreflective/emitter/infrared markers that may be attached to various body points on the user, and/or with markerless systems. This system may be further enhanced using MoCap type devices and systems, for example, active MoCap IMU sensors, inverse kinematics (IK), and/or anatomical models.

In one embodiment, sensor fusion is used to integrate computer vision and IMU data. The sensor fusion comprises synchronization of a plurality of asynchronous data sources such as computer vision and IMU. In one embodiment, the different output variables from computer vision and IMUs are algebraically combined. This may include establishing a shared time framework, for example, NTP and/or a derivative of NTP. A direct socket connection and/or WebRTC may be used to communicate between the data sources. This sensor fusion may be integrated with other data sources such as a trainer video on the mobile device. Latency from processor computation, network conditions, and server conditions may be controlled using a control loop.

FIGS. 6A, 6B, 6C, and 6D are illustrations of an exercise machine accessory for rowing type exercise machines. In one embodiment, the accessory of FIGS. 6A, 6B, 6C, and 6D is a more specific accessory of the type shown in FIG. 2.

Figure 6A:
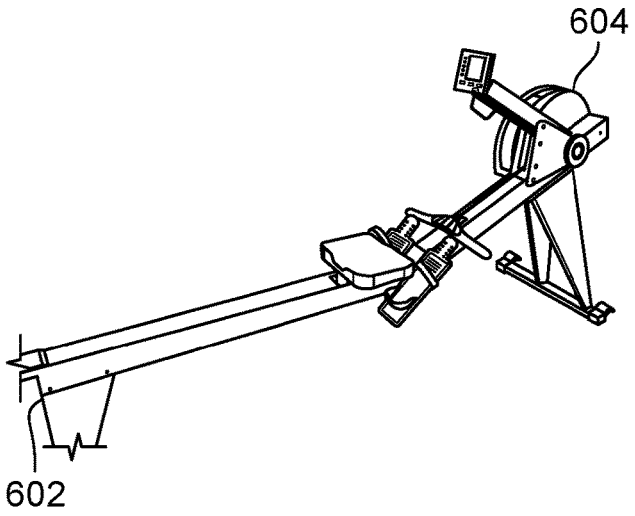
FIGS. 6A, 6B, 6C, and 6D are illustrations of an exercise machine accessory for rowing type exercise machines.
Figure 6B:
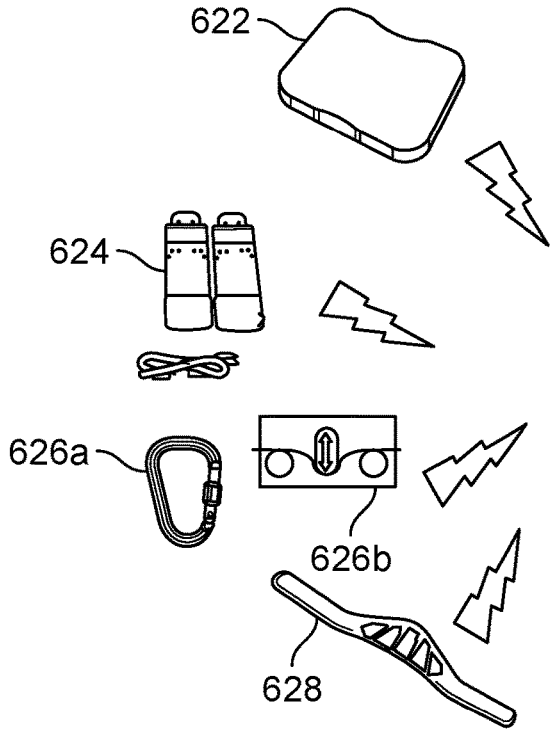

As shown in FIG. 6A, the exercise machine accessory may attach to a rower type exercise machine (602), also known as an ergometer or rowing ergometer which has a user exert rowing type motion against a flywheel (604) for resistance. The flywheel (604) may dampen/offer resistance based on air resistance, water resistance, piston resistance, magnetic resistance, and/or brake resistance. As shown in FIG. 6B, the resistance identifier (252) of FIG. 2 for such rowing machines may be associated with the rowing seat (622) to identify how many cycles a user has rowed, rowing foot mounts (624) to identify foot pressure during rowing, actuator linkage (626*a*), for example, between the rowing handlebar and rowing chain, and/or rowing handlebar (628) to identify force exerted by a user against the flywheel/resistance. Alternately or in combination with the actuator linkage (626*a*), another design to measure rowing chain tension without disconnecting the chain is to use a tension meter (626*b*) allowing the chain to be measured against a perpendicular load cell, similar to that described for tension meter (426) in FIG. 4B. The resistance identifier (252) may also include any device between the user and the exercise machine (602) such as shoes or devices under shoes (not shown).

In one embodiment, the 'smart' resistance identifier device is assigned and/or measures the resistance that the user is exerting against the rowing machine (602) as a resistance identifier (252). For example, a user may use a mobile device camera in conjunction with an optically encoded flywheel attachment using markers to determine the exertion a user is rowing against. Similarly, RFID/NFC markers may be used with wireless receivers to determine the user's rowing exertion.

As a user exercises with the rowing machine (602), the force exerted may be computed based at least in part on compression on the feet (624) and any known actuator/flywheel force (626*a*)/(626*b*), for example, through the use of a load cell/force transducer under the feet, since the user exerts force against the resistance by way of the feet. Similarly, a motion identifier (256) may be used with the feet (624).

In one embodiment, the resistance identifier device (622)/(624)/(626*a*)/(626*b*)/(628) includes a motion identifier (256) based at least in part on an IMU, gyroscope, accelerometer, and/or global positioning sensor, for example, one based on satellites such as GPS, GLONASS, Galileo, BeiDou, IRNSS, and/or QZSS satellites. The motion identifier (256) tracks motion so that a processor coupled with a communications module (254) may analyze the physical work accomplished by a user with the rowing machine (602), and/or analyze a user's form in exercising with the rowing machine. For an indoor exercise experience and/or when external/satellite position is unavailable, a dead reckoning system may be used based at least in part on previously determined position and/or velocity vectors.

In one embodiment, a resistance identifier (252) is a device (not shown) with a system to allow a user to select the current rowing flywheel tension setting, for example, using user tapping, buttons, voice recognition, and/or a touch screen. For example, the user may select "flywheel setting #6," and this is then registered to the user.

In one embodiment, a drift correction system for correcting IMU drift is used in the motion identifier (256). The drift correction system may use any traditional system used, for example, in the virtual reality (VR)/augmented reality (AR)/motion capture (MoCap) field. The drift correction system may further leverage that rowing handlebars (628) are eventually returned to resting at the end of a movement and/or a workout, which provides a known elevation basis/level, i.e., a known x-axis, y-axis, and/or z-axis.

In one embodiment, powering the resistance identifier (252) and/or motion identifier (256) is a battery system, a solar photovoltaic system, and/or a kinetic movement system, for example, one that charges a battery and/or flywheel using motion from the exercise movement itself. In one embodiment, the charging flywheel is the same as the dampening flywheel (604).

As shown in FIG. 6B, there is a communications output for device (622)/(624)/(626*a*)/(626*b*)/(628), herein denoted by a cartoon lightning bolt out of the device. This communications output uses communications module (254) and a network protocol, typically a wireless communications protocol such as BLE (Bluetooth Low Energy), Thread, 6LoWPAN, Bluetooth Mesh, Zigbee, Z-Wave, Wi-Fi HaLow, Bluetooth 5, Wirepas, NFC, RFID, Li-Fi, MiraOS, VEmesh, Wi-Fi, Wi-Fi Direct, Wi-Fi EasyMesh, DASH7, KNX, LonWorks, BACnet, NB-IOT, LTE-Advanced, LTE-M, 5G, LPWAN, LoRaWAN, Sigfox, Weightless, RPMA, and/or VSAT. The communications module (254) communicates with a processor, such as a processor in a mobile device like a phone or tablet, to provide the 'smart exercise machine' features such as virtual coaching, human personal training via a videoconference, team collaboration, performance feedback, competitive leaderboard, congratulatory shout out, live class experience, suggested weight, peer performance/experience, peer feedback, form feedback, form graphical feedback, rep counting, tempo guidance, and/or historical data/statistics.

Figure 6C:
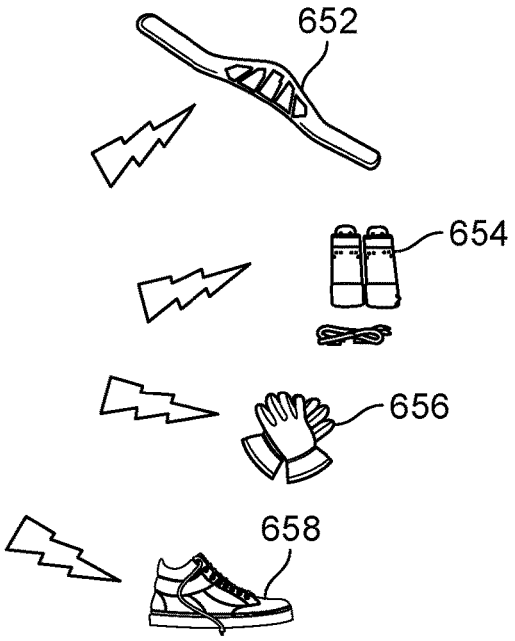

As shown in FIG. 6C, a haptic controller (262) as shown in FIG. 2 may be associated with any device touching the user within an enhanced handlebar (652), rowing foot mount (654), gloves such as sheathed gloves (656), clothing (not shown), and/or shoes (658), e.g., an insole. The haptic controller provides a channel of feedback to a user performing the exercise, for example, to coach a cadence by buzzing a foot when a catch and/or release is scheduled to happen, warn of safety hazards, coach performance, and/or permit gaming and entertainment. As shown in FIG. 6C, there is a communications input for haptic devices (652)/(654)/(656)/(658), herein denoted by a cartoon lightning bolt into the device. This communications input uses communications module (254) and a network protocol.

Figure 6D:
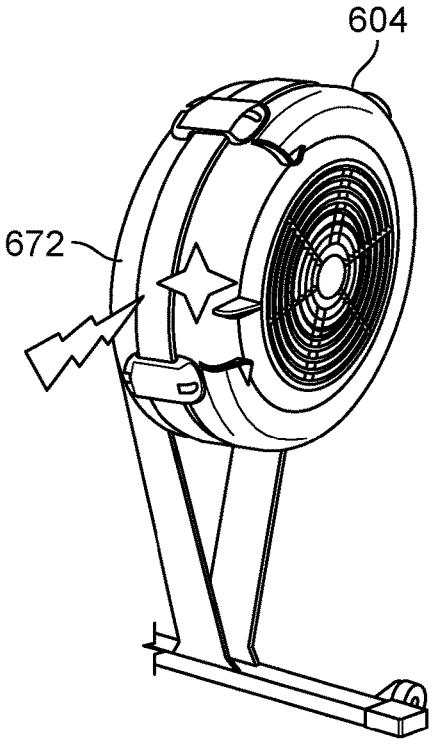

As shown in FIG. 6D, a resistance controller (272) as shown in FIG. 2 may be associated with the rowing machine, for example, by controlling the dampening flywheel resistance (672). In one embodiment, the flywheel controller (672) may be an electromagnetic actuator, for example, a linear/rail actuator, that pushes a flywheel baffle in the similar manner as a human would push it. In one embodiment, the flywheel controller (672) includes a manual override that allows a user to set their own setting without regard to the exercise machine accessory. As an example scenario of the use of the flywheel controller (672), if the exercise machine accessory (220) is simulating an open water rowing rescue scenario, the flywheel resistance may be increased using the controller (672) when the scenario encounters rapid currents and may be decreased using the controller (672) when the scenario encounters calmer waters.

Computer Vision/MoCap. In one embodiment, the exercise machine accessory (220) in FIG. 2 including resistance identifier (252) and/or motion identifier (256) is computer vision-based, not requiring any additional hardware beyond a mobile device. In one embodiment, a mobile device and exercise machine accessory may share the processing of user motion data. The computer vision system may perform resistance identification (252) using computer vision to determine resistance, for example, by observing user motion. This system may be enhanced with a user setup, for example, with a set of bar/QR code/color coded/retroreflective/emitter/infrared markers that may be attached to various body points on the user, and/or with markerless systems. This system may be further enhanced using MoCap type devices and systems, for example, active MoCap IMU sensors, IK, and/or anatomical models.

In one embodiment, sensor fusion is used to integrate computer vision and IMU data. The sensor fusion comprises synchronization of a plurality of asynchronous data sources such as computer vision and IMU. In one embodiment, the different output variables from computer vision and IMUs are algebraically combined. This may include establishing a shared time framework, for example, NTP and/or a derivative of NTP. A direct socket connection and/or WebRTC may be used to communicate between the data sources. This sensor fusion may be integrated with other data sources such as a trainer video on the mobile device. Latency from processor computation, network conditions, and server conditions may be controlled using a control loop.

FIGS. 7A, 7B, 7C, and 7D are illustrations of an exercise machine accessory for cycle type exercise machines. In one embodiment, the accessory of FIGS. 7A, 7B, 7C, and 7D is a more specific accessory of the type shown in FIG. 2.

Figure 7A:
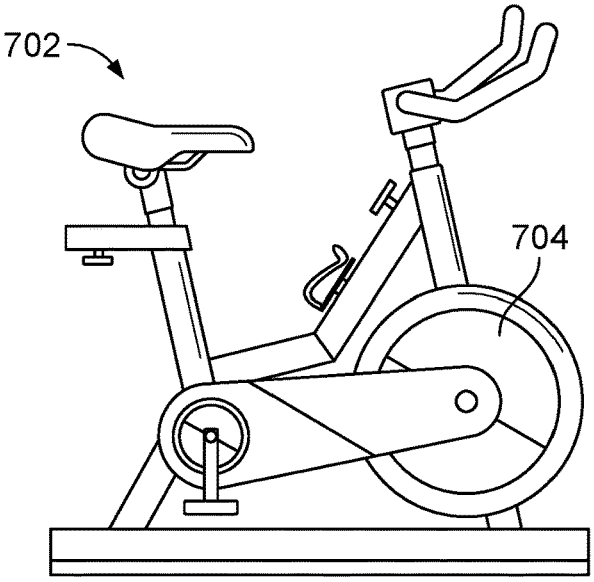
FIGS. 7A, 7B, 7C, and 7D are illustrations of an exercise machine accessory for cycle type exercise machines.
Figure 7B:
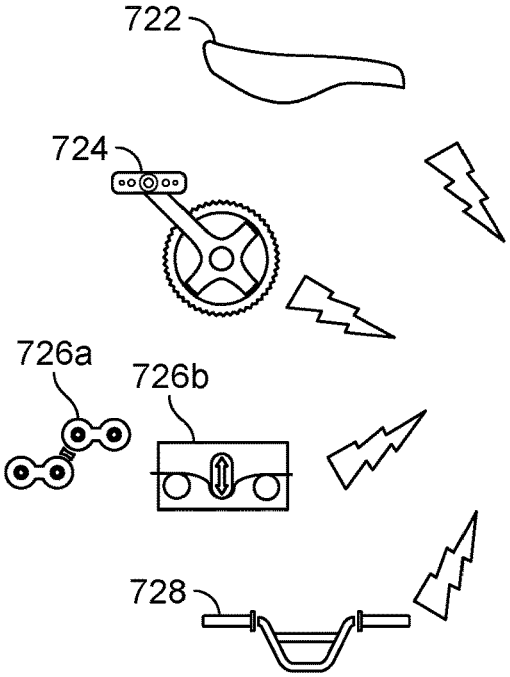

As shown in FIG. 7A, the exercise machine accessory may attach to a cycling machine (702), also known as an exercise bike, spinning bike, or exercycle, which has a user exert cycling type motion against a flywheel (704) for resistance. The flywheel (704) may dampen/offer resistance based on air resistance, fans, water resistance, friction resistance, piston resistance, magnetic resistance, and/or brake resistance. As shown in FIG. 7B, the resistance identifier (252) of FIG. 2 for such cycling machines may be associated with the cycle seat (722) to identify how long a user has cycled, cycling foot pedals/foot mounts/crankcase/clutch plates (724) to identify leg exertion during cycling, actuator linkage (726*a*), for example, between links of the cycle chain, and/or cycling handlebar (728) to identify force exerted by a user against the cycling resistance. Alternately or in combination with the actuator linkage (726*a*), another design to measure cycle chain tension without disconnecting the chain is to use a tension meter (726*b*) allowing the chain to be measured against a perpendicular load cell, similar to that described for tension meter (426) in FIG. 4B. The resistance identifier (252) may also include any device between the user and the exercise machine (702) such as shoes or devices under shoes (not shown).

In one embodiment, the 'smart' resistance identifier device is assigned and/or measures the resistance that the user is exerting against the cycling machine (702) as a resistance identifier (252). For example, a user may use a mobile device camera in conjunction with an optically encoded flywheel attachment using markers to determine the exertion a user is cycling against. Similarly, RFID/NFC markers may be used with wireless receivers to determine the user's cycling exertion.

As a user exercises with the cycling machine (702), the force exerted may be computed based at least in part on compression on the feet (724) and any known actuator/flywheel force (724)/(726*a*)/(726*b*), for example, through the use of a load cell/force transducer under the feet, since the user exerts force against the resistance by way of the feet. Similarly, a motion identifier (256) may be used with the feet (724)/(726*a*)/(726*b*).

In one embodiment, the resistance identifier device (722)/(724)/(726*a*)/(726*b*)/(728) includes a motion identifier (256) based at least in part on an IMU, gyroscope, accelerometer, and/or global positioning sensor, for example, one based on satellites such as GPS, GLONASS, Galileo, BeiDou, IRNSS, and/or QZSS satellites. The motion identifier (256) tracks motion so that a processor coupled with a communications module (254) may analyze the physical work accomplished by a user with the cycling machine (702), and/or analyze a user's form in exercising with the cycling machine. For an indoor exercise experience and/or when external/satellite position is unavailable, a dead reckoning system may be used based at least in part on previously determined position and/or velocity vectors.

In one embodiment, a resistance identifier (252) is a device (not shown) with a system to allow a user to select the current cycling flywheel tension setting, for example, using user tapping, buttons, voice recognition, and/or a touch screen. For example, the user may select "flywheel tension setting #3," and this is then registered to the user.

In one embodiment, a drift correction system for correcting IMU drift is used in the motion identifier (256). The drift correction system may use any traditional system used, for example, in the virtual reality (VR)/augmented reality (AR)/motion capture (MoCap) field. The drift correction system may further leverage that cycling pedals (724) may only be in a specified radius of the crankcase, which provides a known elevation basis/level, i.e., a known x-axis, y-axis, and/or z-axis.

In one embodiment, powering the resistance identifier (252) and/or motion identifier (256) is a battery system, a solar photovoltaic system, and/or a kinetic movement system, for example, one that charges a battery and/or flywheel using motion from the exercise movement itself. In one embodiment, the charging flywheel is the same as the cycle flywheel (704).

As shown in FIG. 7B, there is a communications output for device (722)/(724)/(726*a*)/(726*b*)/(728), herein denoted by a cartoon lightning bolt out of the device. This communications output uses communications module (254) and a network protocol, typically a wireless communications protocol such as BLE (Bluetooth Low Energy), Thread, 6LoWPAN, Bluetooth Mesh, Zigbee, Z-Wave, Wi-Fi HaLow, Bluetooth 5, Wirepas, NFC, RFID, Li-Fi, MiraOS, VEmesh, Wi-Fi, Wi-Fi Direct, Wi-Fi EasyMesh, DASH7, KNX, LonWorks, BACnet, NB-IOT, LTE-Advanced, LTE-M, 5G, LPWAN, LoRaWAN, Sigfox, Weightless, RPMA, and/or VSAT. The communications module (254) communicates with a processor, such as a processor in a mobile device like a phone or tablet, to provide the 'smart exercise machine' features such as virtual coaching, human personal training via a videoconference, team collaboration, performance feedback, competitive leaderboard, congratulatory shout out, live class experience, suggested weight, peer performance/experience, peer feedback, form feedback, form graphical feedback, rep counting, tempo guidance, and/or historical data/statistics.

Figure 7C:
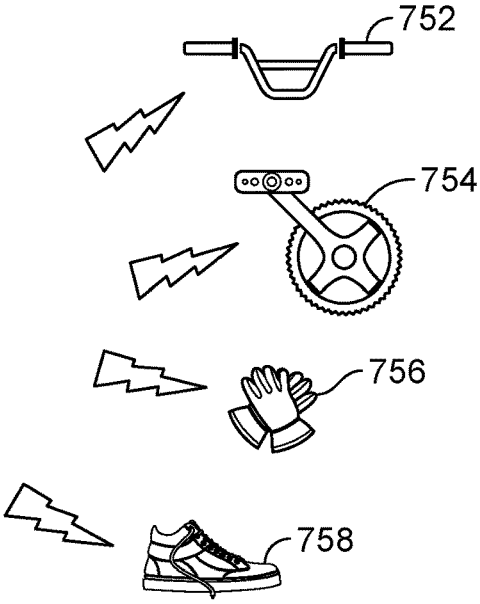

As shown in FIG. 7C, a haptic controller (262) as shown in FIG. 2 may be associated with any device touching the user within an enhanced handlebar (752), cycling foot pedals/foot mounts/crankcase/clutch plates (754), gloves such as sheathed gloves (756), clothing (not shown), and/or shoes (758), e.g., an insole. The haptic controller provides a channel of feedback to a user performing the exercise, for example, to coach a cadence by buzzing a foot when a cycling stroke is scheduled to happen, warn of safety hazards, coach performance, and/or permit gaming and entertainment. As shown in FIG. 7C, there is a communications input for haptic devices (752)/(754)/(756)/(758), herein denoted by a cartoon lightning bolt into the device. This communications input uses communications module (254) and a network protocol.

Figure 7D:
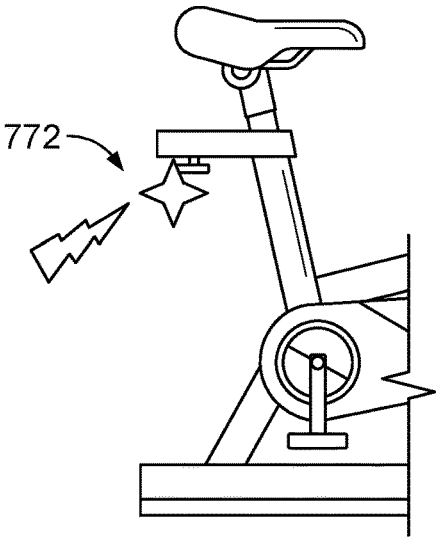

As shown in FIG. 7D, a resistance controller (272) as shown in FIG. 2 may be associated with the cycling machine, for example, by controlling the dampening flywheel resistance (772). In one embodiment, the flywheel controller (772) may be an electromagnetic actuator, for example, a rotational actuator, that twists a tension control in the similar manner as a human would twist it. In one embodiment, the flywheel controller (772) includes a manual override that allows a user to set their own setting without regard to the exercise machine accessory. As an example scenario of the use of the flywheel controller (772), if the exercise machine accessory (220) is simulating a hilly scenario, the flywheel resistance may be increased using the controller (772) when the scenario encounters uphill scenarios and may be decreased using the controller (772) when the scenario encounters downhill scenarios.

Computer Vision/MoCap. In one embodiment, the exercise machine accessory (220) in FIG. 2 including resistance identifier (252) and/or motion identifier (256) is computer vision-based, not requiring any additional hardware beyond a mobile device. In one embodiment, a mobile device and exercise machine accessory may share the processing of user motion data. The computer vision system may perform resistance identification (252) using computer vision to determine resistance, for example, by observing user motion. This system may be enhanced with a user setup, for example, with a set of bar/QR code/color coded/retroreflective/emitter/infrared markers that may be attached to various body points on the user, and/or with markerless systems. This system may be further enhanced using MoCap type devices and systems, for example, active MoCap IMU sensors, IK, and/or anatomical models.

In one embodiment, sensor fusion is used to integrate computer vision and IMU data. The sensor fusion comprises synchronization of a plurality of asynchronous data sources such as computer vision and IMU. In one embodiment, the different output variables from computer vision and IMUs are algebraically combined. This may include establishing a shared time framework, for example, NTP and/or a derivative of NTP. A direct socket connection and/or WebRTC may be used to communicate between the data sources. This sensor fusion may be integrated with other data sources such as a trainer video on the mobile device. Latency from processor computation, network conditions, and server conditions may be controlled using a control loop.

Figure 8A:
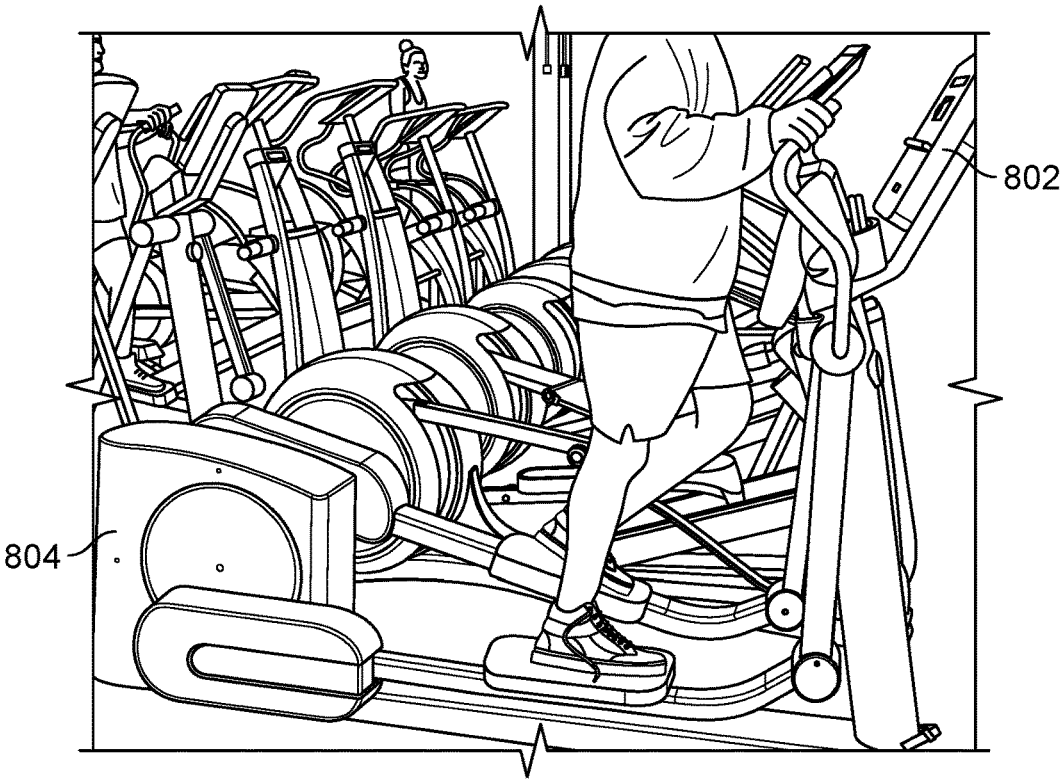
FIGS. 8A, 8B, and 8C are illustrations of an exercise machine accessory for elliptical type exercise machines.
Figure 8B:
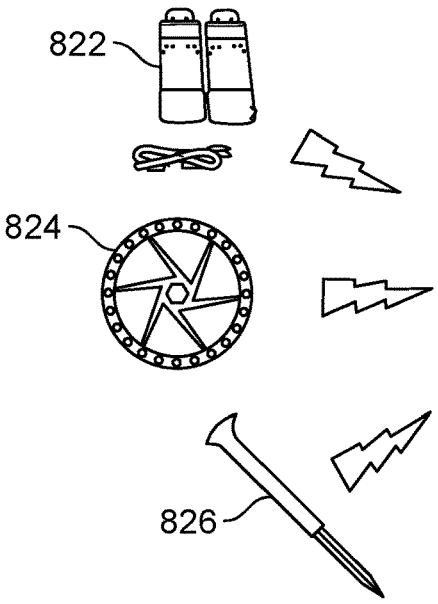
Figure 8C:
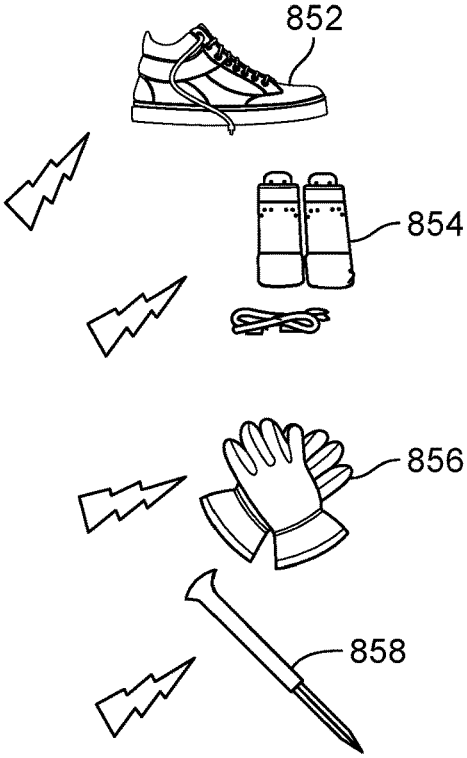

FIGS. 8A, 8B, and 8C are illustrations of an exercise machine accessory for elliptical type exercise machines. In one embodiment, the accessory of FIGS. 8A, 8B, and 8C is a more specific accessory of the type shown in FIG. 2.

As shown in FIG. 8A, the exercise machine accessory may attach to an elliptical type exercise machine (802), which typically includes a flywheel (804) for the user to exert against in a motion similar to that of cross-country skiing. As shown in FIG. 8B, the resistance identifier (252) of FIG. 2 for such treadmill type exercise machines may be associated with the skiing motion, including a foot pedal accessory (822) to track foot motion and load, a flywheel accessory (824) such as an optical/wireless encoder for position sensing and/or an incline sensor to show how fast a user has gone and/or how far a user has gone, and/or a pole accessory (826) to track arm motion and load. The resistance identifier (252) may also include any device between the user and the exercise actuator such as shoes, devices under feet, gloves, and/or devices under hands (not shown).

In one embodiment, the 'smart' resistance identifier device is assigned and/or measures the resistance that the user is exerting against the elliptical type exercise machine (802) as a resistance identifier (252). For example, a user may use a mobile device camera in conjunction with an optically encoded flywheel (824) using visible stickers to determine the speed/distance a user is running. Similarly, RFID/NFC markers may be used with wireless receivers to determine the speed/distance a user is running.

As a user exercises with the elliptical machine (802), the force exerted may be computed based at least in part on compression on the feet (822) and the known gravitational force, for example, through the use of a load cell/force transducer under the feet, since the user exerts force against the resistance by way of the feet. Similarly, a motion identifier (256) may be used with shoes (not shown). This may be supplemented with computing force exerted by arms (826) since the user exerts force against resistance also by way of hands.

In one embodiment, the resistance identifier device (822)/(824)/(826) includes a motion identifier (256) based at least in part on an IMU, gyroscope, accelerometer, and/or global positioning sensor, for example, one based on satellites such as GPS, GLONASS, Galileo, BeiDou, IRNSS, and/or QZSS satellites. The motion identifier (256) tracks motion so that a processor coupled with a communications module (254) may analyze the physical work accomplished by a user with the elliptical type exercise machine (802), and/or analyze a user's form in exercising with the elliptical type exercise machine. For an indoor exercise experience and/or when external/satellite position is unavailable, a dead reckoning system may be used based at least in part on previously determined position and/or velocity vectors.

In one embodiment, a resistance identifier (252) is a device (not shown) with a system to allow a user to select the current elliptical speed, incline and/or difficulty of the machine (802), for example, using user tapping, buttons, voice recognition, and/or a touch screen. For example, the user may select "hills with difficulty #3," and this is then registered to the user.

In one embodiment, a drift correction system for correcting IMU drift is used in the motion identifier (256). The drift correction system may use any traditional system used, for example, in the virtual reality (VR)/augmented reality (AR)/motion capture (MoCap) field.

In one embodiment, powering the resistance identifier (252) and/or motion identifier (256) is a battery system, a solar photovoltaic system, and/or a kinetic movement system, for example, one that charges a battery and/or flywheel using motion from the exercise movement itself. In one embodiment, the charging flywheel is the same as the flywheel (804).

As shown in FIG. 8B, there is a communications output for device (822)/(824)/(826), herein denoted by a cartoon lightning bolt out of the device. This communications output uses communications module (254) and a network protocol, typically a wireless communications protocol such as BLE (Bluetooth Low Energy), Thread, 6LoWPAN, Bluetooth Mesh, Zigbee, Z-Wave, Wi-Fi HaLow, Bluetooth 5, Wirepas, NFC, RFID, Li-Fi, MiraOS, VEmesh, Wi-Fi, Wi-Fi Direct, Wi-Fi EasyMesh, DASH7, KNX, LonWorks, BACnet, NB-IOT, LTE-Advanced, LTE-M, 5G, LPWAN, LoRaWAN, Sigfox, Weightless, RPMA, and/or VSAT. The communications module (254) communicates with a processor, such as a processor in a mobile device like a phone or tablet, to provide the 'smart exercise machine' features such as virtual coaching, human personal training via a videoconference, team collaboration, performance feedback, competitive leaderboard, congratulatory shout out, live class experience, suggested weight, peer performance/experience, peer feedback, form feedback, form graphical feedback, rep counting, tempo guidance, and/or historical data/statistics.

As shown in FIG. 8C, a haptic controller (262) as shown in FIG. 2 may be associated with any device touching the user within shoes (852) e.g., an insole, a foot pedal accessory (854), clothing (not shown), gloves e.g., sheathed gloves (856), and/or a pole accessory (858). The haptic controller provides a channel of feedback to a user performing the exercise, for example, to give a tread cadence by buzzing a foot when a foot fall is scheduled to happen, warn of safety hazards, coach performance, and/or permit gaming and entertainment. As shown in FIG. 8C, there is a communications input for haptic devices (852)/(854)/(856), herein denoted by a cartoon lightning bolt into the device. This communications input uses communications module (254) and a network protocol.

Computer Vision/MoCap. In one embodiment, the exercise machine accessory (220) in FIG. 2 including resistance identifier (252) and/or motion identifier (256) is computer vision based, not requiring any additional hardware beyond a mobile device. In one embodiment, a mobile device and exercise machine accessory may share the processing of user motion data. The computer vision system may perform resistance identification (252) using computer vision to determine resistance, for example, by observing user motion. This system may be enhanced with a user setup, for example, with a set of bar/QR code/color coded/retroreflective/emitter/infrared markers that may be attached to various body points on the user, and/or with markerless systems. This system may be further enhanced using MoCap type devices and systems, for example, active MoCap IMU sensors, IK, and/or anatomical models.

In one embodiment, sensor fusion is used to integrate computer vision and IMU data. The sensor fusion comprises synchronization of a plurality of asynchronous data sources such as computer vision and MI In one embodiment, the different output variables from computer vision and IMUs are algebraically combined. This may include establishing a shared time framework, for example, NTP and/or a derivative of NTP. A direct socket connection and/or WebRTC may be used to communicate between the data sources. This sensor fusion may be integrated with other data sources, such as trainer video on the mobile device. Latency from processor computation, network conditions, and server conditions may be controlled using a control loop.

Figure 9A:
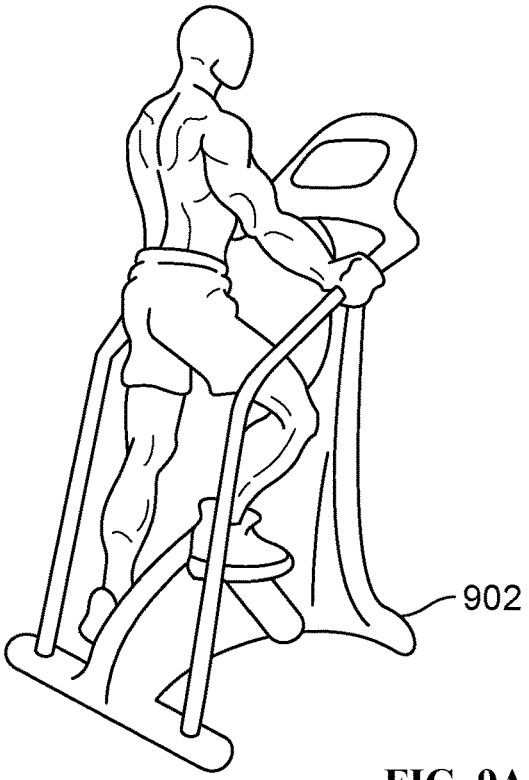
FIGS. 9A, 9B, and 9C are illustrations of an exercise machine accessory for stair climber type exercise machines.
Figure 9B:
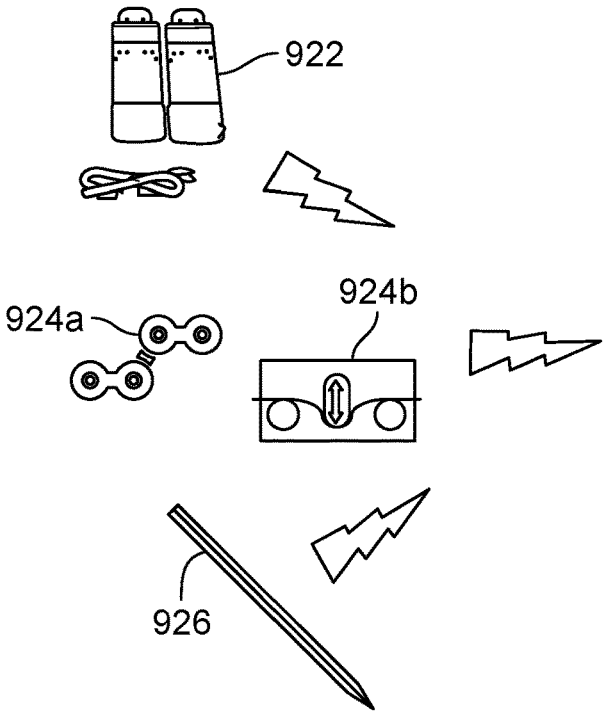
Figure 9C:
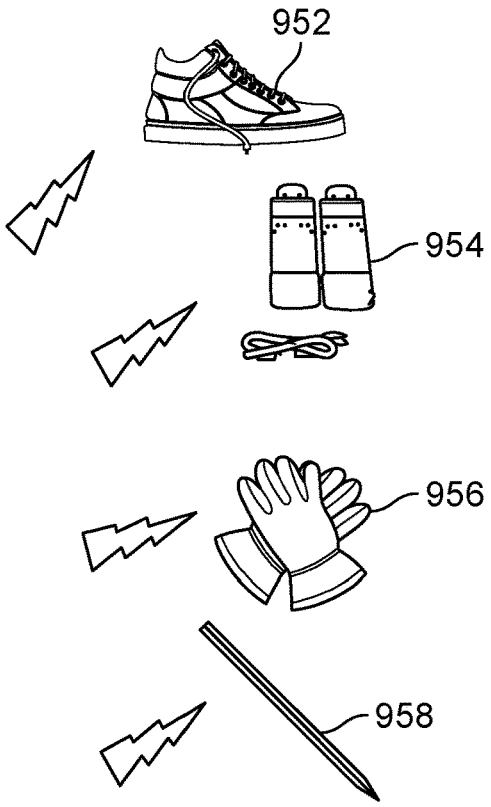

FIGS. 9A, 9B, and 9C are illustrations of an exercise machine accessory for stair climber type exercise machines. In one embodiment, the accessory of FIGS. 9A, 9B, and 9C is a more specific accessory of the type shown in FIG. 2.

As shown in FIG. 9A, the exercise machine accessory may attach to a stair climber/stair stepper machine (902), which typically includes a resistance (not shown) for the user to exert against in a motion similar to that of walking up a staircase. This resistance may be a linked pneumatic cylinder, a rotating stair coupled to a flywheel, and/or a rotating stair coupled to an alternator/brake, and often includes a rail for a user to balance and/or rest against. As shown in FIG. 9B, the resistance identifier (252) of FIG. 2 for such stair climber machines may be associated with the stair motion, including a foot pedal accessory (922) to track foot motion and load, stair linkage (924*a*), for example, between links of the rotating stair chain coupling, and/or a rail accessory (926) to track arm motion and load. Alternately or in combination with the actuator linkage (924*a*), another design to measure chain/cable tension without disconnecting the chain is to use a tension meter (924*b*) allowing the chain/cable to be measured against a perpendicular load cell, similar to that described for tension meter (426) in FIG. 4B. The resistance identifier (252) may also include any device between the user and the exercise actuator such as shoes, devices under feet, gloves, and/or devices under hands (not shown).

In one embodiment, the 'smart' resistance identifier device is assigned and/or measures the resistance that the user is exerting against the stair climber machine (902) as a resistance identifier (252). For example, a user may use a mobile device camera in conjunction with an optically encoded chain (not shown) using visible stickers to determine the speed/distance a user is climbing. Similarly, RFID/NFC markers may be used with wireless receivers to determine the speed/distance a user is climbing.

As a user exercises with the stair climber machine (902), the force exerted may be computed based at least in part on compression on the feet (922) and the known gravitational force, for example, through the use of a load cell/force transducer under the feet, since the user exerts force against the resistance by way of the feet. Similarly, a motion identifier (256) may be used with shoes (not shown). This may be supplemented with computing force exerted by arms (926) since the user may exert force against resistance also by way of hands against the rail.

In one embodiment, the resistance identifier device (922)/(924*a*)/(924*b*)/(926) includes a motion identifier (256) based at least in part on an IMU, gyroscope, accelerometer, and/or global positioning sensor, for example, one based on satellites such as GPS, GLONASS, Galileo, BeiDou, IRNSS, and/or QZSS satellites. The motion identifier (256) tracks motion so that a processor coupled with a communications module (254) may analyze the physical work accomplished by a user with the stair climber machine (902), and/or analyze a user's form in exercising with the stair climber machine. For an indoor exercise experience and/or when external/satellite position is unavailable, a dead reckoning system may be used based at least in part on previously determined position and/or velocity vectors.

In one embodiment, a resistance identifier (252) is a device (not shown) with a system to allow a user to select the current climbing speed, incline, and/or difficulty of the machine (902), for example, using user tapping, buttons, voice recognition, and/or a touch screen. For example, the user may select "hills workout with difficulty #4," and this is then registered to the user.

In one embodiment, a drift correction system for correcting IMU drift is used in the motion identifier (256). The drift correction system may use any traditional system used, for example, in the virtual reality (VR)/augmented reality (AR)/motion capture (MoCap) field.

In one embodiment, powering the resistance identifier (252) and/or motion identifier (256) is a battery system, a solar photovoltaic system, and/or a kinetic movement system, for example, one that charges a battery and/or flywheel using motion from the exercise movement itself. In one embodiment, the charging flywheel is part of the climber resistance.

As shown in FIG. 9B, there is a communications output for device (922)/(924*a*)/(924*b*)/(926), herein denoted by a cartoon lightning bolt out of the device. This communications output uses communications module (254) and a network protocol, typically a wireless communications protocol such as BLE (Bluetooth Low Energy), Thread, 6LoWPAN, Bluetooth Mesh, Zigbee, Z-Wave, Wi-Fi HaLow, Bluetooth 5, Wirepas, NFC, RFID, Li-Fi, MiraOS, VEmesh, Wi-Fi, Wi-Fi Direct, Wi-Fi EasyMesh, DASH7, KNX, LonWorks, BACnet, NB-IOT, LTE-Advanced, LTE-M, 5G, LPWAN, LoRaWAN, Sigfox, Weightless, RPMA, and/or VSAT. The communications module (254) communicates with a processor, such as a processor in a mobile device like a phone or tablet, to provide the 'smart exercise machine' features such as virtual coaching, human personal training via a videoconference, team collaboration, performance feedback, competitive leaderboard, congratulatory shout out, live class experience, suggested weight, peer performance/experience, peer feedback, form feedback, form graphical feedback, rep counting, tempo guidance, and/or historical data/statistics.

As shown in FIG. 9C, a haptic controller (262) as shown in FIG. 2 may be associated with any device touching the user within shoes (952) e.g., an insole, a foot pedal accessory (954), clothing (not shown), gloves e.g., sheathed gloves (956), and/or a rail accessory (958). The haptic controller provides a channel of feedback to a user performing the exercise, for example, to give a tread cadence by buzzing a foot when a foot fall is scheduled to happen, warn of safety hazards, coach performance, and/or permit gaming and entertainment. As shown in FIG. 9C, there is a communications input for haptic devices (952)/(954)/(956)/(958), herein denoted by a cartoon lightning bolt into the device. This communications input uses communications module (254) and a network protocol.

Computer Vision/MoCap. In one embodiment, the exercise machine accessory (220) in FIG. 2 including resistance identifier (252) and/or motion identifier (256) is computer vision based, not requiring any additional hardware beyond a mobile device. In one embodiment, a mobile device and exercise machine accessory may share the processing of user motion data. The computer vision system may perform resistance identification (252) using computer vision to determine resistance, for example, by observing user motion. This system may be enhanced with a user setup, for example, with a set of bar/QR code/color coded/retroreflective/emitter/infrared markers that may be attached to various body points on the user, and/or with markerless systems. This system may be further enhanced using MoCap type devices and systems, for example, active MoCap IMU sensors, IK, and/or anatomical models.

In one embodiment, sensor fusion is used to integrate computer vision and IMU data. The sensor fusion comprises synchronization of a plurality of asynchronous data sources such as computer vision and IMU. In one embodiment, the different output variables from computer vision and IMUs are algebraically combined. This may include establishing a shared time framework, for example, NTP and/or a derivative of NTP. A direct socket connection and/or WebRTC may be used to communicate between the data sources. This sensor fusion may be integrated with other data sources, such as trainer video on the mobile device. Latency from processor computation, network conditions, and server conditions may be controlled using a control loop.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise machine accessory, comprising:

a processor;

a resistance identifier sticker, wherein the resistance identifier sticker is coupled to an exercise machine;

a motion identifier comprising a camera configured to identify exercise motion for a user of the exercise machine using computer vision based at least in part on the camera and processing of user motion data using the processor;

a resistance identifier configured to identify resistance for an exercise machine associated with the exercise machine accessory using computer vision based at least in part on the camera, the resistance identifier sticker, and optical recognition using the processor;

and a communications module configured to communicate with the user of the exercise machine, wherein the communications module is coupled to the resistance identifier and the motion identifier.

2. The exercise machine accessory of claim 1, further comprising:

a resistance controller configured to control resistance for the exercise machine, wherein the resistance controller is coupled to both the exercise machine and the communications module.

3. The exercise machine accessory of claim 1, further comprising:

a haptic controller configured to control haptic feedback for the user of the exercise machine, wherein the haptic controller is coupled to the communications module.

4. The exercise machine accessory of claim 1, wherein the exercise machine includes a free-weight, and wherein the resistance identifier clips to a free-weight.

5. The exercise machine accessory of claim 4, wherein the motion identifier comprises an inertial measurement unit (IMU) including a gyroscope and an accelerometer and wherein the motion identifier is associated with a point between a user's grip and the free-weight.

6. The exercise machine accessory of claim 5, wherein a haptic controller is further configured to give haptic feedback to the user's grip based at least in part on user performance on the exercise machine.

7. The exercise machine accessory of claim 1, wherein the exercise machine is a cable-based exercise machine and wherein the resistance identifier is at least one of the following: a load cell in a weight stack pin for a weight stack coupled to a cable associated with the cable-based exercise machine; and a tensiometer configured to measure tension in the cable.

8. The exercise machine accessory of claim 7, wherein the motion identifier comprises an IMU including a gyroscope and an accelerometer and wherein the motion identifier is associated with a point between a user's grip, the cable, and the weight stack.

9. The exercise machine accessory of claim 8, wherein a haptic controller is further configured to give haptic feedback to the user's grip based at least in part on user performance on the exercise machine.

10. The exercise machine accessory of claim 1, wherein the exercise machine is a treadmill and wherein the resistance identifier is at least one of the following: a treadmill belt position sensor; an optical encoder coupled to the treadmill; and a meter configured to measure incline.

11. The exercise machine accessory of claim 10, wherein the motion identifier comprises an IMU including a gyroscope and an accelerometer and wherein the motion identifier is associated with a user's foot.

12. The exercise machine accessory of claim 11, wherein a haptic controller is further configured to give haptic feedback to the user's foot based at least in part on user performance on the treadmill.

13. The exercise machine accessory of claim 1, wherein the exercise machine is a rowing machine and wherein the resistance identifier is at least one of the following: a damper sensor coupled to a damper resistance mechanism; a piston sensor coupled to a piston resistance mechanism; a brake sensor coupled to a braked flywheel resistance; a magnetic sensor coupled to a magnetic resistance mechanism; an air sensor coupled to an air resistance mechanism; a water sensor coupled to a water resistance mechanism; and a sensor coupled to a slide associated with the rowing machine.

14. The exercise machine accessory of claim 13, wherein the motion identifier comprises an IMU including a gyroscope and an accelerometer and wherein the motion identifier is associated with a user's grip.

15. The exercise machine accessory of claim 14, wherein a haptic controller is further configured to give haptic feedback to a rowing machine seat or the user's grip based at least in part on user performance on the rowing machine.

16. The exercise machine accessory of claim 1, wherein the exercise machine is a stationary bicycle and wherein the resistance identifier is at least one of the following: a magnetic sensor for a magnetic resistance mechanism; a fan sensor for a fan resistance mechanism; a friction sensor for a friction resistance mechanism; a bicycle chain position sensor; and an optical encoder coupled to the stationary bicycle.

17. The exercise machine accessory of claim 16, wherein the motion identifier comprises an IMU including a gyroscope and an accelerometer and wherein the motion identifier is associated with a user's foot.

18. The exercise machine accessory of claim 17, wherein a haptic controller is further configured to give haptic feedback to the user's foot or a user's grip based at least in part on user performance on the stationary bicycle.

19. The exercise machine accessory of claim 1, wherein the exercise machine is an elliptical trainer and wherein the resistance identifier is at least one of the following: a flywheel position sensor; a stride length position sensor; and a meter configured to measure incline in the elliptical trainer.

20. The exercise machine accessory of claim 19, wherein the motion identifier comprises an IMU including a gyroscope and an accelerometer and wherein the motion identifier is associated with a user's foot or a user's grip.

21. The exercise machine accessory of claim 20, wherein a haptic controller is further configured to give haptic feedback to the user's foot or the user's grip based at least in part on user performance on the elliptical trainer.

22. The exercise machine accessory of claim 1, wherein the exercise machine is a stair climbing trainer and wherein the resistance identifier is at least one of the following: a flywheel position sensor; a chain position sensor; a belt position sensor; a stride length position sensor; a meter configured to measure hydraulic pressure; and a meter configured to measure incline in the stair climbing trainer.

23. The exercise machine accessory of claim 22, wherein the motion identifier comprises an IMU including a gyroscope and an accelerometer and wherein the motion identifier is associated with a user's foot or a user's grip.

24. The exercise machine accessory of claim 23, wherein a haptic controller is further configured to give haptic feedback to the user's foot or the user's grip based at least in part on user performance on the stair climbing trainer.

* * * * *